US007727688B2

(12) United States Patent
Yagi

(10) Patent No.: US 7,727,688 B2
(45) Date of Patent: Jun. 1, 2010

(54) ELECTROPHOTOGRAPHIC PHOTORECEPTOR AND MANUFACTURING METHOD THEREOF, PROCESS CARTRIDGE, AND IMAGE FORMING DEVICE

(75) Inventor: Shigeru Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/594,055

(22) Filed: Nov. 8, 2006

(65) Prior Publication Data

US 2007/0269728 A1 Nov. 22, 2007

(30) Foreign Application Priority Data

May 22, 2006 (JP) ..... 2006-141714

(51) Int. Cl.
*G03G 5/082* (2006.01)

(52) U.S. Cl. ..... 430/58.1; 430/66; 430/132; 399/159

(58) Field of Classification Search ..... 430/66; 399/159

See application file for complete search history.

(56) References Cited

U.S. PATENT DOCUMENTS 4,737,429 A * 4/1988 Mort et al. ..... 430/57.5
6,238,832 B1 5/2001 Hashizume et al.
2002/0051918 A1* 5/2002 Miyamoto et al. ..... 430/58.65
2002/0106570 A1* 8/2002 Kami et al. ..... 430/58.05

FOREIGN PATENT DOCUMENTS

| | | | |
|---|---|---|---|
| JP | A 2-110470 | | 4/1990 |
| JP | A 11-186571 | | 7/1999 |
| JP | 2001-265040 | * | 9/2001 |
| JP | A 2003-27238 | | 1/2003 |
| JP | A 2003-29437 | | 1/2003 |
| JP | A 2003-316053 | | 11/2003 |

OTHER PUBLICATIONS

Abstract and Translation of JP 2003-316053 (Nov. 6, 2003).*

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

There is provided: an electrophotographic photoreceptor including a photosensitive layer and a surface layer laminated on a conductive substrate in this order, the photosensitive layer including an organic substance, the surface layer including a group 13 element and nitrogen, a thickness of the surface layer being from about 0.01 μm to less than about 1 μm, and a center line average roughness (Ra) of a surface of the surface layer being about 0.01 μm or less; a manufacturing method thereof; a process cartridge; and an image forming device.

21 Claims, 8 Drawing Sheets

ELECTROPHOTOGRAPHIC PHOTORECEPTOR AND MANUFACTURING METHOD THEREOF, PROCESS CARTRIDGE, AND IMAGE FORMING DEVICE

BACKGROUND

1. Technical Field

The invention relates to an electrophotographic photoreceptor used for a copier for forming an image by an electrophotographic method, a manufacturing method thereof, a process cartridge, and an image forming device.

2. Related Art

Recently, electrophotography is widely used for a copier, a printer, and the like. An electrophotographic photoreceptor (hereunder, also called a "photoreceptor") used for an image forming device utilizing such electrophotography is subjected to various contact or stress in the device, causing deterioration. However, on the other hand, high reliability is desired together with digitalization and colorization of the image forming device.

For example, if an electrification process of a photoreceptor is addressed, there are problems as follows. Firstly, in a noncontact electrification method, discharge products are adhered to the photoreceptor, and image blur and the like occurs. Therefore, in order to remove the discharge products adhered to the photoreceptor, there is employed for example a system where particles having an abrasion function are mixed in a developer and the discharge products are rubbed off in a cleaning section. In this case, the surface of the photoreceptor is deteriorated due to abrasion. On the other hand, recently, a contact electrification method is widely used. In this method, abrasion of the photoreceptor may be also accelerated.

From such a background, a longer lifetime is desired for an electrophotographic photoreceptor. Since abrasion resistance is needed to be improved for a longer lifetime of the electrophotographic photoreceptor, the hardness of the photoreceptor surface is required to be increased.

SUMMARY

According to an aspect of the present invention, there is provided an electrophotographic photoreceptor comprising a photosensitive layer and a surface layer laminated on a conductive substrate in this order, the photosensitive layer including an organic substance, the surface layer including a group 13 element and nitrogen, a thickness of the surface layer being from about 0.01 μm to less than about 1 μm, and a center line average roughness (Ra) (also referred to as "Ra" hereinafter) of a surface of the surface layer being about 0.01 μm or less.

BRIEF DESCRIPTION OF THE DRAWINGS

Exemplary embodiments of the present invention will be described in detail based on the following figures, wherein.

DETAILED DESCRIPTION

Figure 1:
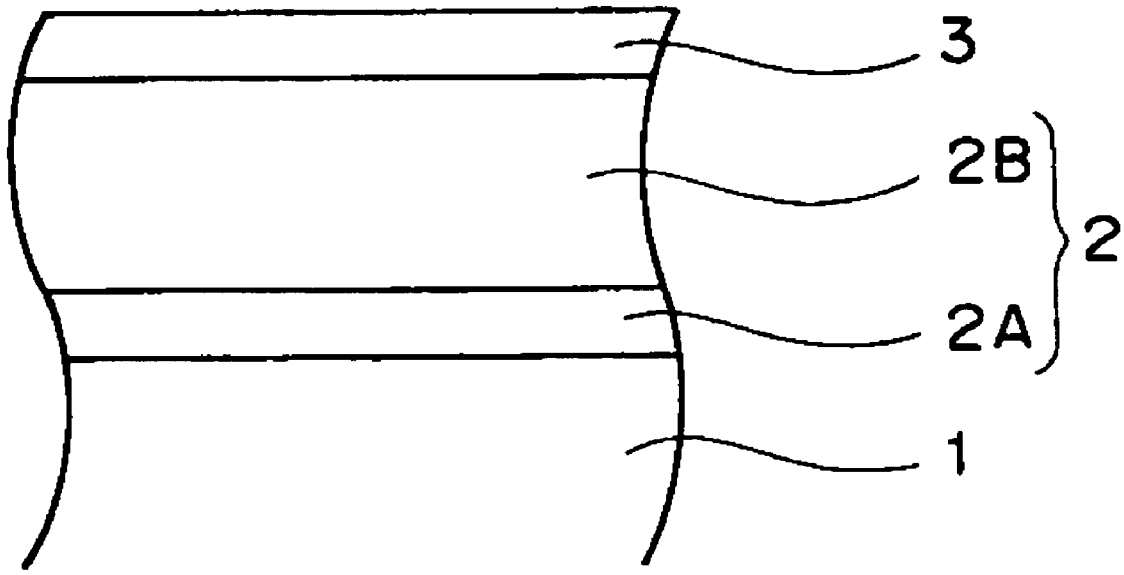
FIG. 1 is a schematic cross section showing an example of a layer structure of a photoreceptor of an exemplary embodiment of the present invention.

Exemplary embodiments of the invention are described in detail hereinafter.

(Electrophotographic Photoreceptor and Method for Manufacturing the Same)

The electrophotographic photoreceptor (may be referred to "photoreceptor" hereinafter) of an exemplary embodiment of the present invention includes a photosensitive layer and a surface layer laminated on a conductive substrate in this order. The photosensitive layer includes an organic substance. The surface layer contains a group 13 element and nitrogen, the thickness of the surface layer is from about 0.01 μm to less than about 1 μm, and the center line average roughness (Ra) of the surface of the surface layer is about 0.1 μm, or less.

The two elements contained in the surface layer of an exemplary embodiment of the present invention may form a nitride compound semiconductor excellent in hardness and transparency. The uppermost surface of the surface layer may be oxidized.

When the above-mentioned surface layer is formed by the same method as the method for manufacturing conventional semiconductors using remote plasma, the temperature of the surface where the layer grows becomes as high as several hundreds degree centigrade. Consequently, when the photosensitive layer is an organic photosensitive layer, the surface of the photosensitive layer is damaged by heat and suffers from melting and decomposition that roughen the surface of the surface layer, and further, the compound in the organic photosensitive layer is deteriorated. Therefore, the effect of providing the surface layer cannot be manifested.

In view of the above-mentioned problems, the inventors have made intensive studies on the method for forming the surface layer of the nitride compound semiconductor using remote plasma that have been proposed by the inventors. It was found that the temperature of the surface where the layer grows can be reduced to less than about 100° C. by using a specified substance as an active species for allowing to react with an organic metal compound containing the group 13 element as will be described later. This method permits a surface layer including the nitride compound semiconductor to be formed on the surface of the organic photoreceptor without impairing the organic photosensitive layer at the lower layer. Thus, an exemplary embodiment of the present invention is accomplished.

Since the surface layer can be formed at a low temperature of less than about 100° C. in this invention, an intact smooth surface can be maintained even after depositing the surface layer without damaging the organic photosensitive layer. Specifically, in the photoreceptor of an exemplary embodiment of the present invention, when the surface layer is formed at a thickness of about 0.01 μm or more and less than about 1 μm, the center line average roughness (Ra) of the surface is 0.1 μm or less.

When the center line average roughness (Ra) of the surface exceeds 0.1 μm, cleaning with a blade or brush becomes insufficient in a cleaning step in the electrophotographic device (image-forming device), and the electrification, development and transfer steps are completed while the toner is left on the surface. Consequently, resolution as well as image density are easily decreased and uneven images and ghosts easily occur. Furthermore, when the center line average roughness (Ra) of the surface exceeds 0.1 μm, the organic photosensitive layer is naturally damaged to cause decrease of sensitivity and elevation of the level of residual potential.

The center line average roughness (Ra) of the surface is preferably about 0.07 μm or less, more preferably about 0.05 μm or less.

When the thickness of the surface layer is less than about 0.01 μm, the surface of the electrophotographic photoreceptor is readily influenced by the photosensitive layer, and mechanical strength becomes insufficient. When the thickness is 1 μm or more, on the other hand, residual potential increases by repeating electrification and exposure, while mechanical internal stress to the photosensitive layer increases to readily generate peeling and cracks.

The thickness of the surface layer is preferably in the range of from about 0.03 μm to 0.7 μm, more preferably from about 0.05 μm to 0.5 μm.

The center line average roughness (Ra) of the surface is obtained as an average of roughness measured at arbitrary 10 positions of the photoreceptor in the axial direction using a surface roughness meter (trade name: SURFCOM 550A, manufactured by TOKYO SEIMITSU Co., Ltd.) under a condition of a cut-off value of 75%, measuring distance of 1.0 mm and scanning speed of 0.12 mm/second.

The thickness of the surface layer is measured using a contact level difference meter (surface roughness meter manufactured by TOKYO SEIMITSU Co., Ltd.) and a photograph of the cross section of a semiconductor film taken with a scanning electron microscope (trade name: S-400, manufactured by HITACHI, Ltd) together.

Hereunder is a description of the structure of the electrophotographic photoreceptor of an exemplary embodiment of the present invention.

FIG. 1 is a schematic cross-section showing an example of a layer structure of a photoreceptor of an exemplary embodiment of the present invention, wherein 1 denotes a conductive substrate, 2 denotes a photosensitive layer, 2A denotes a charge generation layer, 2B denotes a charge transport layer, and 3 denotes a surface layer.

The photoreceptor shown in FIG. 1 has a layer structure where on the conductive substrate 1 is laminated with the charge generation layer 2A, the charge transport layer 2B, and the surface layer 3 in this order. The photosensitive layer 2 includes two layers of the charge generation layer 2A and the charge transport layer 2B.

Figure 2:
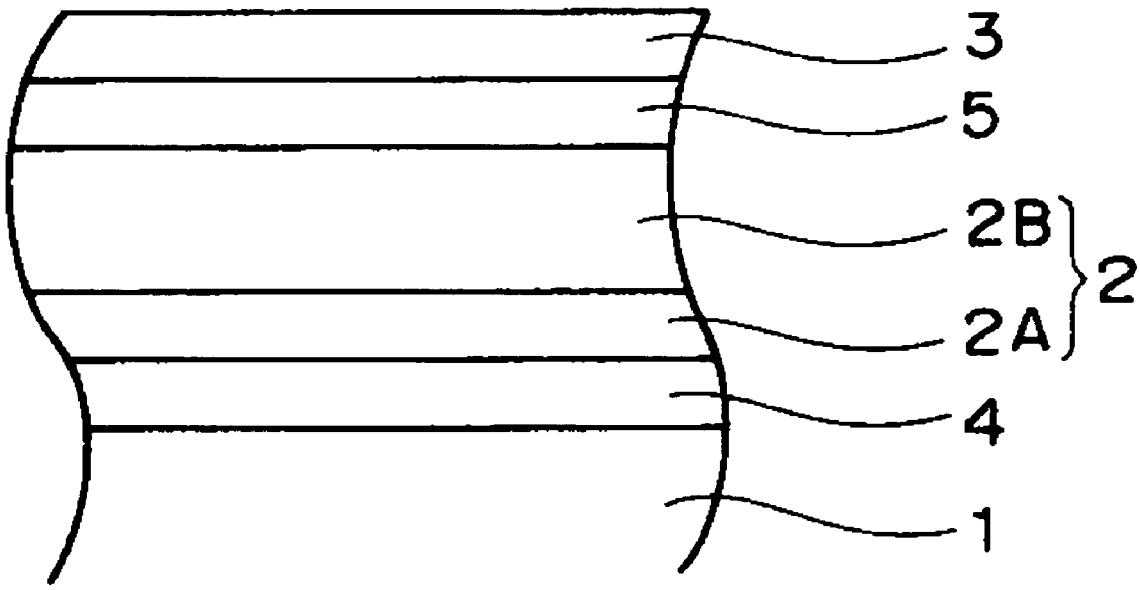
FIG. 2 is a schematic cross section showing another example of the layer structure of the photoreceptor of an exemplary embodiment of the present invention.

FIG. 2 is a schematic cross-section showing another example of a layer structure of the photoreceptor of an exemplary embodiment of the present invention, wherein 4 denotes an under coating layer, 5 denotes an intermediate layer, and the others are the same as shown in FIG. 1. The photoreceptor shown in FIG. 2 has a layer structure where on the conductive substrate 1 is laminated with the under coating layer 4, the charge generation layer 2A, the charge transport layer 2B, the intermediate layer 5, and the surface layer 3 in this order.

Figure 3:
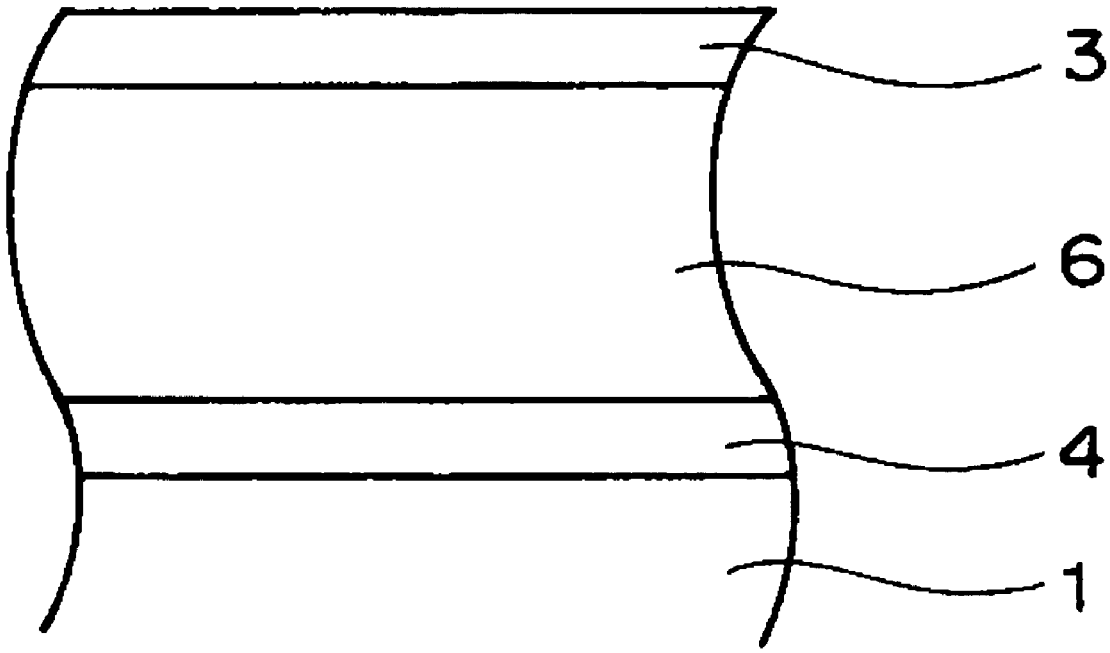
FIG. 3 is a schematic cross section showing a different example of the layer structure of the photoreceptor of an exemplary embodiment of the present invention.

FIG. 3 is a schematic cross-section showing another example of a layer structure of a photoreceptor of an exemplary embodiment of the present invention, wherein 6 denotes the photosensitive layer and the others are the same as shown in FIG. 1 and FIG. 2.

The photoreceptor shown in FIG. 3 has a layer structure where on the conductive substrate 1 is laminated with the photosensitive layer 6 and the surface layer 3 in this order. The photosensitive layer 6 is a layer having integrated functions of a charge generation layer 2A and the charge transport layer 2B shown in FIG. 1 and FIG. 2.

The photosensitive layers 2 and 6 include an organic substance, i.e., a so-called organic photosensitive layer.

While the entire layer of the surface layer 3 of an exemplary embodiment of the present invention may be composed of only a group 13 element and nitrogen, the surface layer 3 may also contain other elements such as hydrogen, carbon and oxygen, as necessary. Since the composition, structure and properties of the surface layer can be readily and flexibly controlled by using such third elements, the above-mentioned effect can be attained at a higher level.

In particular, the surface layer 3 may contain hydrogen as the third element. When the surface layer contains hydrogen, high hardness and transparency as well as electrical stability, chemical stability and mechanical stability in addition to high water repellency and low frictional coefficient may be obtained by compensating dangling bonds and structural defects thanks to the bond between the group 13 element and nitrogen.

The surface layer may also contain oxygen as a fourth element. When the surface layer contains oxygen, antioxidative property in the electrophotographic process in an oxidative atmosphere can be attained.

The composition in the direction of thickness of the surface layer 3 may have a concentration gradient, or the surface layer may have a multilayer structure.

With respect to the concentration distribution of the surface layer 3 in the direction of thickness, for example, when the surface layer contains oxygen, the concentration distribution of nitrogen may increase toward the photosensitive layer side while the concentration distribution of oxygen may decrease toward the photosensitive layer side (or increases toward the surface side of the photoreceptor). Furthermore, most part of the photoreceptor surface side of the surface layer are preferably composed of oxygen and the group 13 element, while the vicinity of the photosensitive layer side of the surface layer preferably includes the group 13 element and another element other than oxygen (or contains no oxygen).

When the photoreceptor has such distribution of the oxygen concentration, mechanical strength, resistance to oxidation and elimination of defective images due to adhesion of discharge products as well as sensitivity may be compatible to one another at a higher level, while such characteristics may be readily maintained for a long period of time. The oxygen concentration distribution profile in the direction of thickness of the surface layer is not particularly restricted, and may be any one of linear, curved or stepwise distribution.

The content of nitrogen in the surface layer 3 is preferably about 60 atomic % or less, more preferably about 50 atomic % or less. When the nitrogen content exceeds about 60 atomic %, the photoreceptor may less practical since water resistance of the surface layer may be insufficient. While distribution of the nitrogen concentration in the direction of thickness of the surface layer may be even or uneven, nitrogen may not be substantially contained in the surface layer. The group 13 element may be multiple elements.

The content ratio of the nitrogen and the group 13 element in the surface layer 3 may be in the range of from about 1.0:0.2 to about 1.0:2.0 as the ratio (x:y) between the total number x of the group 13 element atoms and the total number y of the nitrogen atoms. When the ratio is out of the above-described range, the proportion of the atoms involved in tetrahedral bonds may be small while ionic bonds may increase, and chemical stability and hardness may become insufficient.

Specifically, the group 13 element contained in the surface layer 3 may be at least one selected from B, Al, Ga and In. Two or more elements may be contained in the surface layer. There is no restriction of combination of contents of the elements in the surface layer. When In that absorbs visible light is selected, it is preferable to take into consideration the exposure wavelength and erase wavelength of the electrophotographic system in which the photoreceptor is used so that it does not absorb visible light as small as possible.

The content of elements such as group 13 elements and nitrogen in the uppermost surface of the surface layer 3 as well as the distribution in the direction of thickness can be determined as follows by Rutherford back scattering (may be referred to "RBS" hereinafter).

An accelerator (trade name: 3SDH PELLETRON, manufactured by NEC corporation), an end station (trade name: RBS-400, manufactured by CE & A Co., Ltd.), and a system (trade name: 3S-R10) are used for RBS. The data is analyzed using HYPRA program (trade name, manufactured by CE & A Co., Ltd.).

The measuring condition of RBS is He++ ion beam energy of 2.275 eV, detection angle of 160°, grazing angle with respect to incident beam of about 109°.

The RBS measurement is specifically carried out as follows.

In the RBS measurement, the $He^{++}$ ion beam is incident orthogonally to the sample, and the detector is set at 160° with respect to the ion beam, so as to measure signals of He backscattered. From the detected energy and intensity of He, the composition ratio and the film thickness are determined. In order to improve the accuracy of obtaining the composition ratio and the film thickness, the spectrum may be measured with two detection angles. The accuracy can be improved by measuring and cross checking with two different detection angles having different resolutions in the depth direction and different backscattering dynamics.

The number of He atoms backscattered by target atoms is determined by three factors of; 1) atomic number of the target atom, 2) energy of the He atoms before scattering, and 3) scattering angle. The density is assumed by calculation from the measured composition, and the film thickness is calculated using this. The error of the density is within 20%.

The content of each element in the whole surface layer can be also measured by secondary electron mass spectrometry or X-ray photoelectron spectroscopy (XPS).

The surface layer may contain hydrogen in the range of from about 0.1 atomic % to 50 atomic %. When the content of hydrogen is less than 0.1 atomic %, the surface layer may remain to involve structural distortion in GaN bond, and the layer may be electrically unstable while mechanical characteristics may be insufficient. When the hydrogen content is more than 50 atomic %, on the other hand, the three dimensional structure may not be maintained since the probability of bonding of plural hydrogen atoms to the group 13 element and nitrogen atom may increase, and hardness and chemical stability as well as water resistance may become insufficient.

The hydrogen content can be calculated by Hydrogen Forward Scattering (hereinafter, may be referred to as HFS) as shown below.

For the HFS, an accelerator (trade name: 3SDH PELLETRON, manufactured by NEC), and an endstation (trade name: RBS-400, manufactured by CE&A Co., Ltd.) are used, and a 3S-R10 is used as the system. The HYPRA program of CE & A Co., Ltd. is used for analysis. The measurement conditions of the HFS are as follows.

$He^{++}$ Ion Beam Energy: 2.275 eV

Detection Angle 160°

Grazing Angle with respect to incident beam 30°

In the HFS measurement, by setting the detector at 30° with respect to the $He^{++}$ ion beam, and the sample at 75° with respect to the normal line, signals of hydrogen scattered in front of the sample can be taken. At this time, preferably the detector is covered with a thin aluminum foil to remove He atoms scattered together with hydrogen. The amount is measured by comparing the hydrogen counts of the reference sample and the target sample after standardization by the stopping power. As the reference sample, an H ion injected Si sample and muscovite were used. The muscovite is known to have a hydrogen concentration of about 6.5 atomic %. H adsorbed in the most outer surface can be measured by subtracting the H amount adsorbed on a clean Si surface.

Moreover, the hydrogen content can be estimated by the strength of the group 13 element-hydrogen bond or the N—H bond, using infrared absorption spectrum measurement.

A Fourier transform IR absorption spectrometer system B (trade name: SPECTRUM ONE, manufactured by Perkin Elmer, Inc., S/N ratio 30000:1, resolution 4 $cm^{-1}$) is used for the measurement of IR absorption spectra. The sample in which a film is formed on a silicon wafer with a dimension of 10 mm×10 mm is placed on a sample table with a beam condenser and measured. A silicon wafer having no film formed thereon is used as a reference.

A linear line obtained by connecting troughs of absorption peaks at 1100 $cm^{-1}$ and 800 $cm^{-1}$ is extrapolated toward a low wavenumber side as a base line, and the height of a vertical line from the peak of the absorption of GaN to the cross point with the base line is defined as a total absorption intensity. The lateral peak width at the half height of the peak is defined as a half width of absorption of GaN.

While the surface layer 3 may be either microcrystalline, polycrystalline or amorphous, the surface layer is preferably amorphous for improving smoothness of the surface of the photoreceptor. More preferably, the surface layer is amorphous containing micro-crystals, or microcrystalline/polycrystalline containing the amorphous material from the view point of stability and hardness. Crystalline/amorphous may be judged by the presence or absence of dots and lines of diffraction images obtained by a measurement of RHEED (Reflection High Energy Electron Diffraction).

For the measurement of RHEED (Reflection High Energy Electron Diffraction), electron diffraction images are observed as follows using an RHEED apparatus (trade name: MB-1000, manufactured by EIKO Engineering Co., Ltd.).

A measuring sample of GaN:H grown on a silicon wafer with a dimension of 10 mm×10 mm is horizontally placed on a sample table at the center of an analysis chamber, which is evacuated at a pressure of about $1\times10^{-4}$ Pa or lower with a turbo pump. The voltage of an electron gun is set at about −15 kV. The incident angle to the sample, XY deflector and focus of the electron beam are adjusted so that a diffraction image is projected on a screen placed opposed to the electron gun. The projected image is photographed with a digital camera and evaluated.

Various dopants may be added to the surface layer for controlling the conduction type. When conductance of the surface layer is controlled to be n-type, for example, at least one element selected from Si, Ge and Sn may be added. When controlled to be p-type, for example, at least one element selected from Be, Mg, Ca, Zn and Sr may be added.

The surface layer 3 is liable to contain many defects such as defective bonds, dislocations and defects at crystal grain boundaries in its internal structure even when the layer is micro-crystalline, polycrystalline or amorphous. Accordingly, the surface layer may contain hydrogen and/or a halogen element for inactivating these defects. Hydrogen atoms and/or halogen atoms in the surface layer are incorporated into the defective bonds in the crystal and defects at the crystal grain boundaries to quench active points of reaction and serve for electrical compensation. Consequently, since diffusion and movement of the carriers in the surface layer is suppressed from being trapped, residual potential due to internal accumulation of charges by repeating electrification and exposure is suppressed from elevating, and electrification characteristics of the surface of the photoreceptor may be further stabilized.

Each layer of the photoreceptor of an exemplary embodiment of the present invention will be described in more detail along with the method for manufacturing the same.

The layer structure of the photoreceptor of an exemplary embodiment of the present invention includes a photosensitive layer and a surface layer laminated on a conductive substrate in this order. The photosensitive layer of an exemplary embodiment of the present invention is an organic photosensitive layer including an organic substance. An undercoating layer such as an intermediate layer may be provided between these layers, if necessary. The photosensitive layer may include plural layers as described above, and each layer may have a different function (function separation type).

The organic polymer compound forming the photosensitive layer may be thermoplastic or thermosetting, or it may be formed by reacting two types of molecules. Moreover, between the photosensitive layer and the surface layer may be provided an intermediate layer from the viewpoints of adjusting the hardness, the coefficient of expansion, and the elasticity, improving the adhesiveness, and the like. The intermediate layer may show intermediate characteristics with respect to both of the physical characteristics of the surface layer and the physical characteristics of the photosensitive layer (charge transport layer in the case of the function separation type). Moreover, if the intermediate layer is provided, the intermediate layer may act as a layer which traps charges.

The organic photosensitive layer may be a function separation type photosensitive layer 2 having the charge generation layer 2A and the charge transport layer 2B separately as shown in FIG. 1 and FIG. 2, or may be a function integration type photosensitive layer 6 as shown in FIG. 3. In the case of the function separation type, the surface side of the photoreceptor may be provided with the charge generation layer, or the surface side may be provided with the charge transport layer. A photosensitive layer will be described below focusing on the function separation type photosensitive layer 2.

If a surface layer 3 is formed on the photosensitive layer by a method described later, in order to prevent decomposition of the photosensitive layer 2 due to the irradiation of electromagnetic radiation of shorter wavelengths other than heat, the photosensitive layer surface may be previously provided with a short-wavelength light absorber layer against ultraviolet light or the like, prior to formation of the surface layer 3. Moreover, so as not to irradiate short-wavelength light onto the photosensitive layer 2, a layer having a small band gap may be firstly formed at the initial stage for forming the surface layer 3. The composition of such a layer having a small band gap provided on the photosensitive layer side, for example, may be $Ga_X In_{(1-X)}$ ($0 \leqq X \leqq 0.99$) including In.

Moreover, the layer containing an ultraviolet absorber (for example, a layer formed by application or the like of a layer dispersed in a polymeric resin) may be provided on the photosensitive layer surface.

In this manner, prior to formation of the surface layer 3, the photoreceptor surface is provided with the intermediate layer 5, and thereby effects on the photosensitive layer by short-wavelength light such as ultraviolet light when forming the surface layer 3, corona discharge if the photoreceptor is used in the image forming device, or ultraviolet light from other various light sources may be prevented.

While the surface layer 3 may be either amorphous or crystalline as described above, it is preferable that the undercoating layer (the photosensitive layer side) of the surface layer 3 is microcrystalline and the upper layer (the surface side of the photoreceptor) of the surface layer 3 are also amorphous for enhancing adhesiveness to the photosensitive layer 2 (or intermediate layer 5) and for improving slidability of the surface of the photoreceptor.

The surface layer 3 may be injected with charges during electrification. In this case, the electric charge should be trapped at the interface between the surface layer 3 and photosensitive layer 2. Alternatively, the charge may be trapped on the surface of the surface layer 3. For example, when the photosensitive layer 2 is a layer of a function separation type as shown in FIGS. 1 and 2, the surface at the surface layer side of the charge transporting layer may serve for trapping the charge when electrons are injected from the negatively charged surface layer 3, or an intermediate layer 5 may be provided between the charge transporting layer and surface layer 3 for blocking injection of the charge and trapping. The process may be the same when the surface layer is positively charged.

Moreover, the surface layer 3 may have a function as the charge injection blocking layer, or may also have a function as the charge injection layer. In this case, as described above, by adjusting the conduction type of the surface layer 3 to n-type or p-type, the surface layer 3 may act as the charge injection blocking layer, or as the charge injection layer too.

If the surface layer 3 acts as the charge injection layer, charges are trapped on the surface of the intermediate layer 5 or the photosensitive layer 2 (surface on the surface layer side). In the case of negative electrification, an n-type surface layer acts as the charge injection layer and a p-type surface layer acts as the charge injection blocking layer. In the case of positive electrification, an n-type surface layer acts as the charge injection blocking layer and a p-type surface layer acts as the charge injection layer.

(Formation of the Surface Layer)

The method for forming the surface layer 3 will be described below. The surface layer 3 may be formed directly on the photosensitive layer so that the group 13 element and nitrogen are contained. The surface of the photosensitive layer 2 may be cleaned with plasma.

For the formation of the surface layer 3, there may be used a publicly known vapor phase film-formation method, such as plasma CVD (Chemical Vapor Deposition) method, the organic metal vapor deposition method, the molecular-beam epitaxy method or the like. Hereinafter, the formation of the surface layer 3 will be described with reference to the drawings of the apparatus used for forming the surface layer 3.

Figure 4A:
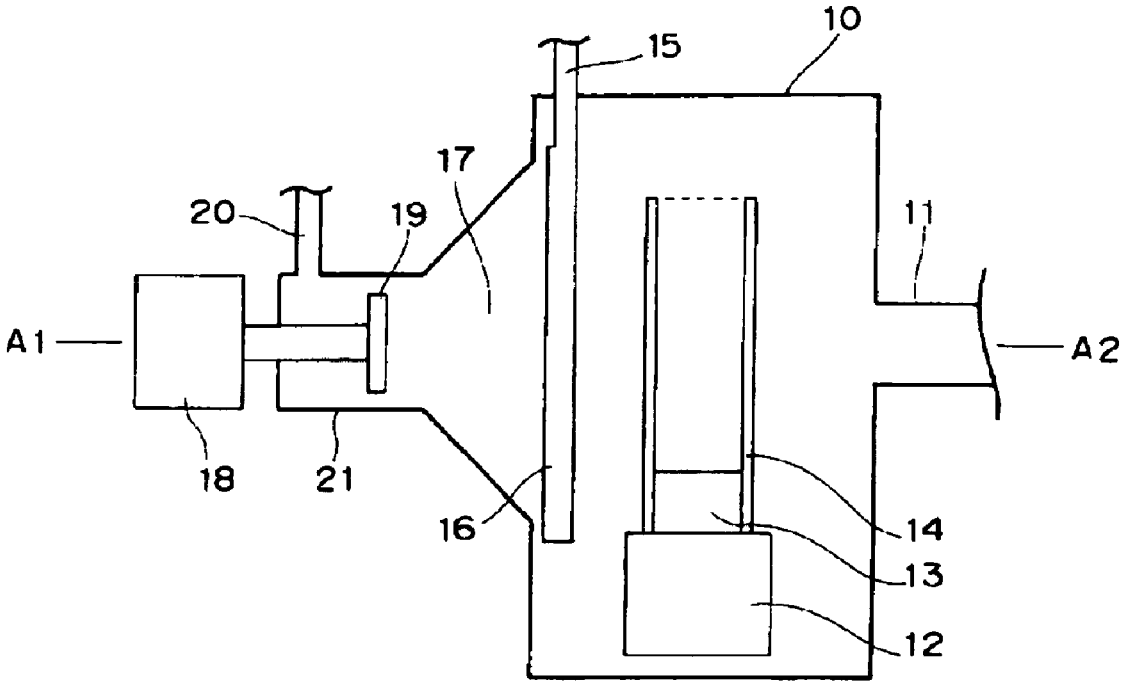
FIG. 4A is a schematic drawing showing an example of a film-forming apparatus used for forming the surface layer of the photoreceptor of an exemplary embodiment of the present invention.
Figure 4B:
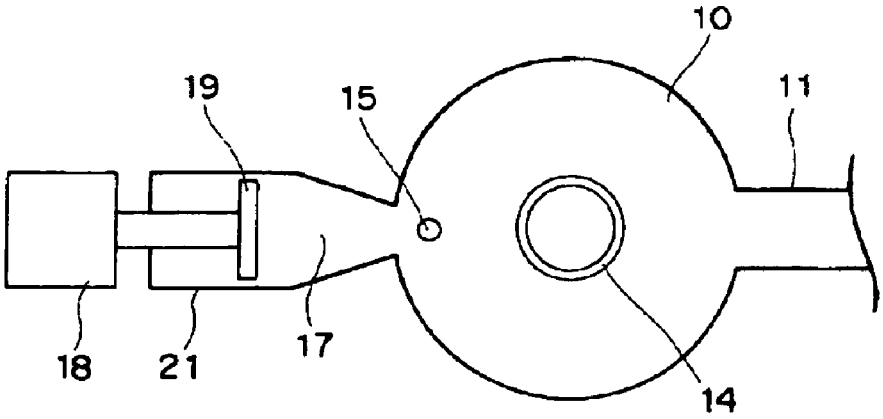
FIG. 4B is a schematic drawing showing an example of the film-forming apparatus used for forming the surface layer of the photoreceptor of an exemplary embodiment of the present invention.

FIG. 4A and FIG. 4B are schematic diagrams showing an example of a film-forming apparatus used for forming the surface layer 3 of the photoreceptor of an exemplary embodiment of the present invention, wherein FIG. 4A is a schematic cross-section of the film-forming apparatus viewed from the side, and FIG. 4B is a schematic cross-section between A1-A2 of the film-forming apparatus shown in FIG. 4A. In FIG. 4A and FIG. 4B, 10 denotes a film formation chamber, 11 denotes an outlet, 12 denotes a substrate rotation section, 13 denotes a substrate holder, 14 denotes a substrate (a conductive substrate provided with an organic photosensitive layer or the like thereon), 15 denotes a gas introduction pipe, 16 denotes a shower nozzle, 17 denotes a plasma diffusion portion, 18 denotes a high frequency power supply section, 19 denotes a plate electrode, 20 denotes a gas introduction pipe, and 21 denotes a high frequency discharge pipe portion.

In the film-forming apparatus shown in FIG. 4A and FIG. 4B, one end of the film formation chamber 10 is provided with the outlet 11 connected to a vacuum exhauster (not shown), and the opposite side of the film formation chamber 10 to where the outlet 11 is provided is provided with a plasma-generating device including the high frequency power supply section 18, the plate electrode 19, and the high frequency discharge pipe portion 21.

This plasma-generating device includes the high frequency discharge pipe portion 21, the plate electrode 19 which is arranged in the high frequency discharge pipe portion 21 and has the discharge face provided on the outlet 11 side, and the high frequency power supply section 18 which is arranged outside of the high frequency discharge pipe portion 21 and is connected to the opposite face to the discharge face of the plate electrode 19. The high frequency discharge pipe portion 21 is connected with the gas introduction pipe 20 for supplying a gas into the high frequency discharge pipe portion 21. The opposite end of this gas introduction pipe 20 is connected with a first gas supply source (not shown).

Figure 5:
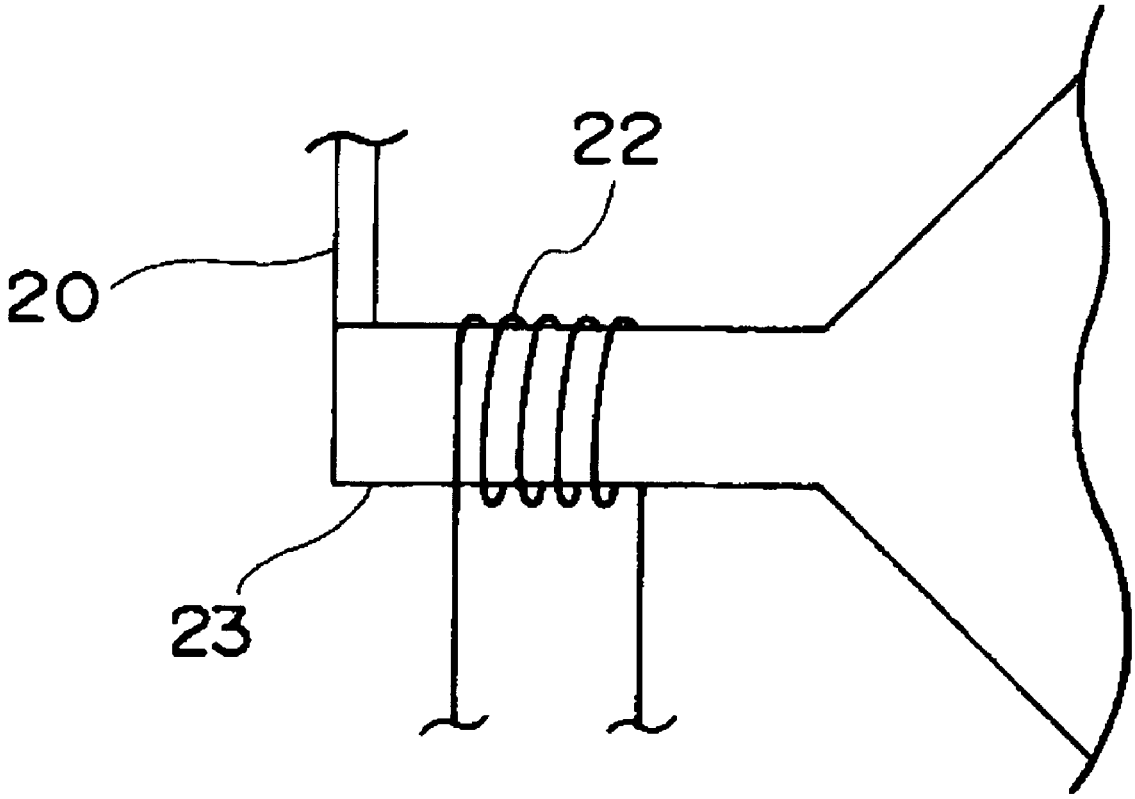
FIG. 5 is a schematic drawing showing an example of a different plasma generating device capable of using in an exemplary embodiment of the present invention.

Instead of the plasma-generating device provided in the film-forming apparatus shown in FIG. 4A and FIG. 4B, a plasma-generating device shown in FIG. 5 may be used. FIG. 5 is a schematic diagram showing another example of the plasma-generating device that can be used in the film-forming apparatus shown in FIG. 4A and FIG. 4B, and a side view of the plasma-generating device.

In FIG. 5, 22 denotes a high frequency coil, 23 denotes a silica tube, and 20 is the same pipe as the one shown in FIG. 4A and FIG. 4B. This plasma-generating device includes a silica tube 23, and a high frequency coil 22 provided along the peripheral face of the silica tube 23. One end of the silica tube 23 is connected with the film formation chamber 10 (not shown in FIG. 5). Moreover, the other end of the silica tube 23 is connected with the gas introduction pipe 20 for introducing a gas into the silica tube 23.

The discharge face side of the plate electrode 19 in FIG. 4A and FIG. 4B is connected with a rod-shaped shower nozzle 16 which is approximately in parallel with the discharge face. The other end of the shower nozzle 16 is connected with the gas introduction pipe 15. This gas introduction pipe 15 is connected with a second gas supply source (not shown) provided out of the film formation chamber 10.

Moreover, in the film formation chamber 10 is provided a substrate rotation section 12, so that a cylindrical substrate 14 can be attached to the substrate rotation section 12 via the substrate holder 13 so as to face the longitudinal direction of the shower nozzle and the axial direction of the substrate 14 approximately in parallel. For forming the film, the substrate 14 can be rotated in the axial direction by rotation of the substrate rotation section 12. As to the substrate 14, there is used a substrate on which the photosensitive layer has been laminated, or a substrate on which the intermediate layer of the photosensitive layer has been laminated.

The surface layer 3 may be formed as follows, for example. Firstly, a mixture gas of an $N_2$ gas and an $H_2$ gas are introduced from the gas introduction pipe 20 into the high frequency discharge pipe 21, and radio waves of about 13.56 MHz are supplied from the high frequency power supply section 18 to the plate electrode 19. At this time, the plasma diffusion portion 17 is formed so as to be radially spread from the discharge face side of the plate electrode 19 to the outlet 11 side. The plate electrode 19 may have the electrode surrounded by an earth shield. Thus, the $N_2$ gas (a compound including nitrogen) and $H_2$ gas are simultaneously activated to obtain an activated species.

Next, by introducing a trimethylgallium gas (organic metal compound including a group 13 element) that has been diluted using hydrogen as a carrier gas into the film formation chamber 10 through the gas introduction pipe 15 and the shower nozzle 16, the activated nitrogen and trimethylgallium are reacted in an atmosphere in which activated hydrogen is included, as a result, a film containing hydrogen, nitrogen and gallium can be formed on the surface of the substrate 14.

A hydrogen-containing compound of the group 13 element and nitrogen may be deposited on the substrate by introducing $N_2$ gas and $H_2$ gas into a high frequency discharge tube as described above in order to decompose trimethylgallium gas by simultaneously forming an active species in an exemplary embodiment of the present invention. It is possible to form the surface layer while the temperature of the surface of the substrate (the surface of the photosensitive layer) is less than about 100° C.

The layer growing on the surface of the substrate can be efficiently etched with active hydrogen generated by plasma discharge, when hydrogen gas and nitrogen gas are simultaneously activated in the plasma in order to allow the activated gases to react with the organic metal compound containing the group 13 element. This process permits a layer of the compound containing the group 13 element and nitrogen having a comparative quality to the layer grown at a high temperature to be formed at a low temperature of less than 100° C. on the surface of an organic substance (organic photosensitive layer) without damaging the organic substance. Consequently, a surface layer with a center line average roughness (Ra) of the surface of about 0.1 μm can be formed as described above.

While hydrogen liberated by activating the organic metal compound containing hydrogen atom that has been once introduced into the film-forming apparatus may be used as the hydrogen source activated with plasma, it is desirable that larger amount of hydrogen atoms than nitrogen atoms are activated since fewer amount of excess hydrogen is released from the surface when the growth temperature is low. Accordingly, it is preferable to directly introduce hydrogen gas at an activating region together with nitrogen gas than using hydrogen atoms contained in the organic metal compound as the hydrogen source.

While activation of hydrogen gas introduced at the downstream by activated nitrogen may be used, a layer excellent in hardness and having good quality may not be easily formed by this method when the deposition temperature is low since there is low etching effect on the surface of the substrate.

Specifically, the hydrogen gas concentration in a mixed gas of nitrogen gas and hydrogen gas supplied for activation is preferably in the range of from about 10% to about 95% by volume. When the concentration of hydrogen gas is less than about 10% by volume, the etching reaction may be insufficient at a low temperature, and the layer may be unstable in the atmosphere with insufficient water resistance since a nitride compound of the group 13 element having a high content of hydrogen is formed. When the concentration of hydrogen gas is larger than about 95% by volume, the growth rate of the layer may become low due to excess etching reaction during the growth of the layer and the layer may become rather defective with roughened growth surface when the hydrogen content is too large.

The hydrogen gas concentration is preferably in the range of from about 10% to about 90% by volume.

Hydrogen gas and nitrogen gas may be introduced into the film-forming apparatus from different positions to one another or may be introduced as a mixture. When hydrogen gas and nitrogen gas are introduced from different positions, both gases are preferably activated simultaneously for effectively obtaining the above-mentioned etching effect. A gas containing the nitrogen atom and hydrogen atom together such as $NH_3$ as a feed material of hydrogen and nitrogen and may be used and activated with plasma, for simplifying the apparatus. The method using the nitrogen gas and hydrogen gas is more suitable considering above-mentioned problem of the amount of hydrogen. A mixed gas of $NH_3$, hydrogen and nitrogen gases may be used.

The temperature for forming the surface layer 3 should be less than about 100° C. as the surface temperature of the substrate (the surface temperature of the photosensitive layer) during formation the surface layer 3. Since the photosensitive layer 2 may be damaged by heat due to the actual forming temperature of about 100° C. or higher by the effect of plasma even when the surface temperature of the substrate is less than about 100° C., the surface temperature of the substrate is preferably adjusted by taking such effect into consideration.

The surface temperature of the substrate is preferably in the range of about 80° C. or lower, more preferably in the range of about 50° C. or lower. The term "the surface temperature of the photosensitive layer" used in an exemplary embodiment of the present invention refers to a temperature of the surface of the entire layer including a layer such as an intermediate layer further provided on the surface of the organic photosensitive layer.

The temperature of the surface of the substrate 14 may be controlled by a heating and/or cooling device (not shown in the drawing), or may be left to a natural temperature increase at the time of discharge. When the substrate 14 is heated, the heater may be set inside or outside of the substrate 14. When the substrate 14 is cooled down, a cooling gas or liquid may be circulated inside the substrate 14.

If the temperature increase of the surface of the substrate 14 due to discharge is to be avoided, it is effective to control the high energy gas flow in contact with the surface of the substrate 14. In this case, conditions such as gas flow, discharge output, and pressure are adjusted for a necessary temperature.

As to the gas containing the group 13 element, instead of trimethylgallium gas, trietylgallium can be used. An organometallic compound containing indium or aluminum instead of gallium may be used. A hydride such as diborane may be used. Two or more types thereof may be mixed and used.

For example, at the beginning of the film formation of the surface layer 3, if a film containing nitrogen and indium is formed on the substrate 14 by introducing trimethylindium into the film formation chamber 10 through the gas introduction pipe 15 and the shower nozzle 16, this film can absorb ultraviolet rays which are generated if the film is continuously formed, and which deteriorate the photosensitive layer 2. As a result, damage to the photosensitive layer 2 due to the generation of ultraviolet rays at the time of film formation can be suppressed.

When forming a film with excellent property at low temperature according to an exemplary embodiment of the present invention, a ratio of the mixed gas of nitrogen and hydrogen gases to the gas containing the group 13 element and a career gas (the mixed gas: the gas containing the group 13 element (volume ratio)) in the film formation chamber 10 may be in the range of from about 1:50 to about 1:1000. The pressure determines the whole gas flow rate into the film formation chamber 10 and it may be in the rage from about 13.3 Pa to 133 Pa.

Moreover, the surface layer 3 may be added with a dopant in order to control its conduction type. As to the method of doping at the time of film formation, there may be used $SiH_3$ and $SnH_4$ for n-type, and biscyclopentadienylmagnesium, dimethylcalcium, dimethylstrontium, dimethylzinc, and diethylzinc for p-type in gas state. Moreover, in order to dope a dopant element in the surface layer, there may be employed a publicly known method such as a thermal diffusion method and an ion implantation method.

Specifically, by introducing a gas containing at least one dopant element into the film formation chamber 10 through the gas introduction pipe 15 and the shower nozzle 16, a surface layer of any conduction type such as n-type and p-type can be obtained.

By means of the abovementioned method, the activated hydrogen and nitrogen, and the group 13 element are present on the substrate 14, and furthermore the activated hydrogen has an effect of releasing hydrogen of a hydrocarbon group such as a methyl group and an ethyl group included in the organometallic compound, as a molecule. As a result, on the surface of the substrate 14 is formed a surface layer 3 of a hard film, where hydrogen, nitrogen and the group 13 element constitute a three dimensional bonding, at a low temperature.

Differing from carbon atoms of $sp^2$ bond type contained in a silicone carbide, such a hard film becomes transparent since Ga and N forms $sp^3$ bonds such as carbon atoms constituting a diamond. Furthermore, this hard film can be made into a film containing oxygen by introducing oxygen by natural oxidization or an oxidization treatment using such as oxygen or ozone after film formation. This film is transparent and hard, and the surface of the film is water repellant with low friction.

In the plasma-generating device of the film-forming apparatus shown in FIG. 4A and FIG. 4B, a high frequency oscillator is used. However, the activating means is not limited to this. For example, there may be used a microwave oscillator, and a device of an electrocyclotron resonance type or helicon plasma type. Moreover, in the case where a high frequency oscillator is used, it may be either an inductive or capacitive type.

The high frequency oscillator is preferred so as not to increase the temperature of the surface of the substrate 14 due to plasma irradiation, however there may be provided a device which prevents the heat irradiation.

In an exemplary embodiment of the present invention, in the case of, for example, high frequency discharge, the frequency may be in a rage of 10 kHz to 50 MHz, for forming a high quality film at a low temperature. The output may vary depending on the size of the substrate, and may be in a range of from about 0.01 $W/cm^2$ to about 0.2 $W/cm^2$. The rotating velocity of the substrate may be in a range of from about 0.1 rpm to about 100 rpm.

If two or more types of different plasma-generating devices (a plasma generating means) are used, it is necessary that discharges occur at the same pressure at the same time. Moreover, between the discharge area and the film formation area (portion where the substrate is set) may be provided a pressure difference. These devices may be arranged in series with respect to a gas flow formed in the film-forming apparatus, from a portion into which the gas is introduced, to a portion from which it is discharged. All devices may be arranged so as to face a film formation surface of the substrate 14.

For example, if two types of plasma-generating devices are arranged in series with respect to the gas flow, using the film-forming apparatus shown in FIG. 4A and FIG. 4B as an example, there may be used a second plasma-generating device which discharges electricity in the film formation chamber 10 using the shower nozzle 16 as the electrode. In this case, a high frequency voltage can be applied to the shower nozzle 16 through the gas introduction pipe 15, so as to discharge electricity in the film formation chamber 10 using the shower nozzle 16 as the electrode. Alternatively, instead of using the shower nozzle 16 as the electrode, between the substrate 14 in the film formation chamber 10 and the plate electrode 19 may be provided a cylindrical electrode, so as to discharge electricity in the film formation chamber 10 using this cylindrical electrode.

Moreover, if two different types of plasma-generating devices are used under the same pressure, for example if a microwave oscillator and a high frequency oscillator are used, the excitation energy of the excited species can be greatly changed, which is effective for controlling the film quality. Furthermore, electricity may be discharged in the vicinity of the atmosphere. If electricity is discharged in the vicinity of the atmosphere, He is desirably used as a carrier gas.

In the case of using two or more of plasma generating devices in an exemplary embodiment of the present invention, the substrate may be cooled because the base surface temperature is easily increased.

For forming the surface layer 3, other than the abovementioned methods, there may be used a normal organic metal vapor deposition method and molecular-beam epitaxy method. For film formation by these methods, usage of active nitrogen and/or active hydrogen is also effective for lowering the temperature. In this case, as to the nitrogen material, there may be used a gas such as $N_2$, $NH_3$, $NF_3$, $N_2H_4$, and methylhydrazine, or vaporized liquid or liquid bubbled by a carrier gas.

—Conductive Substrate and Photosensitive Layer—

Next is a description of details of the conductive substrate and the photosensitive layer of the electrophotographic photoreceptor of an exemplary embodiment of the present invention, and details of the under coating layer and the intermediate layer provided as required, in the case where the electrophotographic photoreceptor of an exemplary embodiment of the present invention is an organic photoreceptor including a function separation type organic photosensitive layer (configuration of FIG. 1 and FIG. 2).

Examples of the conductive substrate 1 include: a metal drum of for example aluminum, copper, iron, stainless, zinc, and nickel; a metal such as aluminum, copper, gold, silver, platinum, palladium, titanium, nickel-chromium, stainless steel, and copper-indium deposited on a base material such as a sheet, a paper, a plastic, and a glass; a conductive metal compound such as indium oxide and tin oxide deposited on the base material; a metal foil laminated on the base material; and carbon black, indium oxide, tin oxide-antimony oxide powder, metal powder, copper iodide, and the like dispersed into a binder resin and applied on the base material for conduction treatment. Moreover, the shape of the conductive substrate may be any one of drum shape, sheet shape, and plate shape.

Moreover, if a metal pipe substrate is used as the conductive substrate, the surface of the metal pipe substrate may be the original pipe as it is. However, it is also possible to roughen the surface of the substrate surface by a surface treatment in advance. Such a surface roughening can prevent the uneven concentration in the grain form due to the coherent light which may occur in the photoreceptor if a coherent light source such as a laser beam is used as an exposure light source. The method of surface treatment includes specular cutting, etching, anodization, rough cutting, centerless grinding, sandblast, and wet honing.

In particular, from the point of improving the adhesiveness with the photosensitive layer 2 and improving the film forming property, one having an anodized surface of the aluminum substrate may be used as the conductive substrate.

Hereunder is a description of a method of manufacturing the conductive substrate having the anodized surface. First, as to the substrate, pure aluminum or aluminum alloy (for example, aluminum or aluminum alloy of number between 1000 and 1999, between 3000 and 3999, or between 6000 and 6999 defined in JIS standard No. K4080, the disclosure of which is incorporated by reference) is prepared. Next, anodization is performed. The anodization is performed in an acid bath of for example chromic acid, sulfuric acid, oxalic acid, phosphoric acid, boric acid, and sulfamic acid. Treatment using a sulfuric acid bath is often used. The anodization is performed for example under a condition of about sulfuric acid concentration: from about 10 weight % to about 20 weight %: bath temperature: from about 5° C. to about 25° C., current density: from about 1 $A/dm^2$ to about 4 $A/dm^2$, bath voltage: from about 5V to about 30V, and treatment time: about 5 minutes to about 60 minutes, however it is not limited to this.

The anodized film formed on the aluminum substrate in this manner is porous and highly insulative, and has a very unstable surface. Therefore, after forming the film, the physical characteristics value is easily changed over time. In order to prevent this change of the physical characteristics value, the anodized film is further sealed. Example of the sealing methods include a method of soaking the anodized film in an aqueous solution containing nickel fluoride or nickel acetate, a method of soaking the anodized film in boiling water, and a method of treating by steam under pressure. Among these methods, the method of soaking in an aqueous solution containing nickel acetate is most often used.

On the surface of the anodized film that has been sealed in this manner, metal salts and the like adhered by the sealing remain in excess. If such metal salts and the like remain in excess on the anodized film of the substrate, not only the quality of the coating film formed on the anodized film is badly affected, but also low resistant components tend to remain in general. Therefore, if this substrate is used for the photoreceptor to form an image, it becomes the causative factor of scumming.

Here, following the sealing, washing of the anodized film is performed in order to remove the metal salts and the like adhered by the sealing. The washing may be such that the substrate is washed once, however it may be such that the substrate is washed by multisteps of washing. As this time, as the washing solution at the last washing step, there is used clean (deionized) washing solution as much as possible. Moreover, in any one step among the multisteps of washing, a physical rubbing washing using a contact member such as a brush may be performed.

The thickness of the anodized film on the surface of the conductive substrate formed as above may be within a range of about 3 μm to about 15 μm. On the anodized film is present a layer called a barrier layer along the porous shaped most outer surface of a porous anodized film. The thickness of the barrier layer may be in a range of from about 1 nm to about 100 nm in the photoreceptor of an exemplary embodiment of the present invention. In the above manner, the anodized conductive substrate 1 can be obtained.

In the conductive substrate 1 obtained in this manner, the anodized film formed on the substrate by anodization has a high carrier blocking property. Therefore, the photoreceptor using this conductive substrate can be installed in the image forming device so as to prevent point defects (black dots and scumming) occurring if print off development (negative/positive development) is performed, and to prevent current leak phenomenon from a contact electrification device which often occurs at the time of contact electrification. Moreover, by sealing the anodized film, the change of the physical characteristics value over time after forming the anodized film, may be prevented. Moreover, by washing the conductive substrate after sealing, the metal salts and the like adhered on the surface of the conductive substrate by sealing may be removed. If an image is formed by an image forming device comprising a photoreceptor produced using this conductive substrate, it is possible to sufficiently prevent the occurrence of scumming.

Next is a description of the under coating layer provided as necessary.

Examples of the material of the under coating layer 4 include: a polymeric resin compound such as an acetal resin (for example, polyvinyl butyral), a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol-formaldehyde resin, and a melamine resin; an organometallic compound containing zirconium, titanium, aluminum, manganese, silicon atoms, and the like.

These compounds may be used solely, or as a mixture or polycondensate of multiple compounds. Among them, an organometallic compound containing zirconium or silicon is preferably used since it has a low residual potential, low potential change due to environment, and low potential change due to repetitive usage. Moreover, the organometallic compound may be used solely, or as a mixture of two or more types, or a mixture with the abovementioned binder resin.

Examples of the organic silicon compound (organometallic compound containing silicon atoms) include vinyltrimethoxysilane, γ-methacryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N, N-bis(β-hydroxyethyl)-γ-aminopropyltriethoxysilane, and γ-chloropropyltrimethoxysilane. Among them, there is preferably used a silane coupling agent such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)3-aminopropyltrimethoxysilane, N-2-(aminoethyl)3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

Examples of the organic zirconium compound (organometallic compound containing zirconium) include zirconium butoxide, ethyl zirconium acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the organic titanium compound (organometallic compound containing titanium) includes tetraisopropyl titanate, tetranormalbutyl titanate, butyl titanate dimer, tetra (2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate and polyhydroxytitanium stearate.

The organic aluminum compound (organometallic compound containing aluminum) includes aluminum isopropylate, monobutoxyaluminum diisopropylate, aluminum butyrate, diethylacetoacetate aluminum diisopropylate and aluminum tris(ethylacetoacetate).

Moreover, examples of the solvent used for the under coating layer forming coating liquid which is for forming the under coating layer 4 include a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate. These solvents may be used solely or as a mixture of two or more types. As a solvent which can be used when two or more types of solvents are mixed, any solvent may be used as long as a binder resin can be dissolved therein as a mixed solvent.

In the formation of the under coating layer 4, firstly an under coating layer forming coating liquid that has been formulated by dispersing and mixing under coating layer coating agent and a solvent is prepared, and applied on the surface of the conductive substrate. As the application method of the under coating layer forming coating liquid, there may be used a normal method such as a dip coating method, a ring coating method, a wire bar coating method, a spray coating method, a blade coating method, a knife coating method, and a curtain coating method. If the under coating layer is formed, it may be formed so that the thickness is in a range of from about 0.1 μm to about 3 μm. By setting the thickness of the under coating layer within such a thickness range, potential increase due to desensitization or repetition may be prevented without overstrengthening the electrical barrier.

In this manner, by forming the under coating layer 4 on the conductive substrate, the wettability when coating to form a layer on the under coating layer may be improved, and it can sufficiently serve a function as an electrical blocking layer.

The surface roughness of the under coating layer 4 formed by the above can be adjusted so as to have a roughness within a range between 1 and 1/(4n) times the laser wavelength λ for exposure to be used (where n is the refractive index of a layer provided on the periphery of the under coating layer). The surface roughness is adjusted by adding resin particles in the under coating layer forming coating liquid. By so doing, if the photoreceptor formed by adjusting the surface roughness of the under coating layer is used for the image forming device, interference fringes due to the laser source may be sufficiently prevented.

As the resin particles, there may be used silicone resin particles, crosslink-type PMMA resin particles, and the like. Moreover, for adjusting the surface roughness, the surface of the under coating layer may be ground. As the grinding method, there may be used buffing, sandblasting, wet honing, grinding treatment, and the like. In the photoreceptor used for the image forming device of the configuration of positive electrification, laser incident beams are absorbed in the vicinity of the most outer surface of the photoreceptor, and further scattered in the photosensitive layer. Therefore, it is not so strongly needed to adjust the surface roughness of the under coating layer.

Moreover, various additives may be added into the under coating layer forming coating liquid, in order to improve the electrical characteristic, the environmental stability, and the image quality. As the additive, there may be used a publicly known material, for example: an electron transport material such as a quinone compound such as chloranil, bromoanil, and anthraquinone, a tetracyanoquinodimethane compound, a fluorenone compound such as 2,4,7-trinitrofluorenone and 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)1,3,4 oxadiazole, a xanthone compound, a thiophene compound, a diphenoquinone compound such as 3,3',5,5' tetra-t-butyldiphenoquinone; an electron transport pigment such as polycyclic or azo, a zirconium chelate compound, a titanium chelate compound, an aluminum chelate compound, a titanium alkoxide compound, an organic titanium compound, and a silane coupling agent.

Specific examples of the silane coupling agent used here include silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

However, it is not limited to these.

Specific examples of the zirconium chelate compound include zirconium butoxide, zirconium ethyl acetoacetate, zirconium triethanolamine, acetylacetonate zirconium butoxide, ethyl acetoacetatezirconium butoxide, zirconium acetate, zirconium oxalate, zirconium lactate, zirconium phosphnate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include tetraisopropyl titanate, tetranormalbutyl titanate, butyl titanate dimer, tetra(2-ethylhexyl)titanate, titaniumacetylacetonate, polytitaniumacetylacetonate, titanium octylene glycolate, titanium lactate ammonium salt, titanium lactate, titanium lactate ethyl ester, titanium triethanolaminate and polyhydroxytitanium stearate.

Specific examples of the aluminum chelate compound include aluminum isopropylate, monobutoxyaluminum diisopropylate, aluminum butyrate, diethylacetoacetate aluminum diisopropylate and aluminum tris(ethylacetoacetate).

These additives may be used solely, or as a mixture or polycondensate of multiple compounds.

Moreover, the abovementioned under coating layer forming coating liquid may contain at least one type of electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferably used fluorenones, quinines, and benzene derivatives having an electron attractive substituent such as Cl, CN, and $NO_2$. As a result, in the photosensitive layer, the photosensitivity may be improved, the residual potential may be decreased, and the deterioration of photosensitivity when used repeatedly may be reduced. The uneven concentration of the toner image formed by the image forming device including the photoreceptor containing an electron accepting material in the under coating layer may be sufficiently prevented.

Moreover, a dispersion type under coating layer coating agent described below may be used instead of the abovementioned under coating layer coating agent. As a result, by appropriately adjusting the resistance of the under coating layer, residual charge may be prevented from being accumulated, and the under coating layer may be made thicker. Therefore, the leak resistance of the photoreceptor may be improved, in particular, leaking at the time of contact electrification may be prevented.

This dispersion type under coating layer coating agent may be, for example, those obtained by dispersing, in a binder resin, metal powder such as aluminum, copper, nickel, and silver; conductive metal oxide such as antimony oxide, indium oxide, tin oxide, and zinc oxide; and conductive material such as carbon fiber, carbon black, and graphite powder. As the conductive metal oxide, metal oxide particles having a mean primary particle size of about 0.5 μm or less may be used. If the mean primary particle size is too large, conduction paths are often generated locally, readily causing current leaking, which may result in the occurrence of fogging or leaking of large current from the electrification device. The under coating layer 4 is needed to be adjusted to an appropriate resistance in order to improve the leak resistance. Therefore, the abovementioned particles having a mean primary particle size of about 0.5 μm or less may have a powder resistance of about $10^2$ Ω·cm to about $10^{11}$ Ω·cm or less.

If the resistance of the metal oxide particle is lower than the lower limit of the above range, sufficient leak resistance may not be obtained. If it is higher than the upper limit of this range, the residual potential may be increased. Consequently, among them, metal oxide particles such as stannic oxide, titanium oxide, and zinc oxide are preferably used. Moreover, the metal oxide particles may be used in a mixture of two or more types thereof. Furthermore, by performing the surface treatment on the metal oxide particles using a coupling agent, the resistance of the powder may be controlled. As the coupling agent that may be used in this case, similar materials as those for the abovementioned under coating layer forming coating liquid can be used. Moreover, these coupling agents may be used in a mixture of two or more types thereof.

In this surface treatment of the metal oxide particles, any publicly known method can be used, and either a dry method or wet method may be used.

If a dry method is used, firstly the metal oxide particles are heated and dried, to remove the surface adsorbed water. By removing the surface adsorbed water, the coupling agent may be evenly adsorbed on the surface of the metal oxide particles. Next, while stirring the metal oxide particles by a mixer or the like having a large shearing force, the coupling agent, either directly or dissolved in an organic solvent or water, is dropped or sprayed with dry air or nitrogen gas, and thereby the treatment is evenly performed. When the coupling agent is dropped or sprayed, the treatment may be performed at a temperature of about 50° C. or more. After adding or spraying the coupling agent, printing may be further performed at a temperature of about 100° C. or more. By the effect of the printing, the coupling agent can be cured and a firm chemical reaction with the metal oxide particles can be generated. The printing may be performed at a temperature at which a desired electrophotographic characteristic is obtained, for any range of time.

If a wet method is used, similarly to the dry method, firstly the surface adsorbed water on the metal oxide particles is removed. As the method of removing the surface adsorbed water, in addition to the heat and dry method which is similar to the dry method, there may be performed a method of removing by stirring and heating in a solvent used for surface treatment, and a method of removing by azeotroping with a solvent. Next, the metal oxide particles are stirred in a solvent, and dispersed by using ultrasonic waves, a sandmill, an attritor, a ball mill, or the like. The coupling agent solution is added thereinto, and stirred or dispersed. Then, the solvent is removed, and thereby the treatment is evenly performed. After removing the solvent, printing may be further performed at a temperature of about 100° C. or more. The printing may be performed at a temperature at which a desired electrophotographic characteristic is obtained, for any range of time.

The amount of the surface treatment agent with respect to the metal oxide particles may be an amount by which a desired electrophotographic characteristic is obtained. The electrophotographic characteristic is affected by the amount of the surface treatment agent adhered on the metal oxide particles after surface treatment. In the case of the silane coupling agent, the adhered amount is obtained by the Si intensity measured by fluorescent X-ray spectroscopy (caused by silane coupling agent), and the intensity of the main metal element used in the metal oxide. The Si intensity measured by fluorescent X-ray spectroscopy may be within a range of about $1.0\times10^{-5}$ times or more and about $1.0\times10^{-3}$ times or less of the intensity of the main metal element used in the metal oxide. If it is lower than this range, image defects such as blushing may often occur. If it exceeds this range, the concentration may be often decreased due to an increase in the residual potential.

Examples of the binding resin contained in the dispersion type under coating layer coating agent include: a publicly known polymeric resin compound such as an acetal resin (for example, polyvinyl butyral), a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and an urethane resin; a charge transport resin having a charge transport group; and a conductive resin such as polyaniline.

Among them, there is preferably used a resin that is insoluble in a coating solvent of a layer formed on the under coating layer. In particular, a phenol resin, a phenol-formaldehyde resin, a melamine resin, an urethane resin, an epoxy resin, and the like are preferably used. The ratio of the metal oxide particles to the binder resin in the dispersion type under coating layer forming coating liquid may be arbitrarily set within a range by which a desired photoreceptor characteristic may be obtained.

Examples of the method of dispersing the metal oxide particles that have been surface treated by the above method into the binder resin, include a method using a media disperser such as a ball mill, a vibratory ball mill, an attritor, a sandmill, and a horizontal sandmill, or a medialess disperser such as an agitator, an ultrasonic disperser, a roll mill, and a high pressure homogenizer. Furthermore, examples of the high voltage homogenizer include a collision method where a dispersing liquid is dispersed by liquid-liquid collision or liquid-wall collision under a high pressure, and a penetration method where a dispersing liquid is dispersed by making it penetrate through minute channels under a high pressure.

The method of forming the under coating layer by this dispersion type under coating layer coating agent can be performed similarly to the method of forming the under coating layer using the abovementioned under coating layer coating agent.

Next is a description of the photosensitive layer 2, separately for the charge transport layer 2B and the charge generation layer 2A in this order.

Examples of the charge transport material used for the charge transport layer 2B are as follows. That is, there is used a hole transport material such as: oxadiazoles such as 2,5-bis (p-diethylaminophenyl)-1,3,4-oxadiazole; pyrazolines such as 1,3,5-triphenyl-pyrazoline, and 1-[pyridyl-(2)]-3-(p-diethylaminostyryl)-5-(p-diethylaminostyryl)pyrazoline; an aromatic tertiary amino compound such as triphenylamine, tri(p-methyl)phenylamine, N,N-bis(3,4-dimethylphenyl)biphenyl-4-amine, dibenzylaniline, and 9,9-dimethyl-N,N-di (p-tolyl)fluorenone-2-amine; an aromatic tertiary diamino compound such as N,N'-diphenyl-N,N'-bis(3-methylphenyl)-[1,1-biphenyl]-4,4'-diamine; 1,2,4-triazines such as 3-(4'dimethylaminophenyl)-5,6-di-(4'-methoxyphenyl)-1,2,4-triazine; hydrazones such as 4-diethylaminobenzaldehyde-1,1-diphenylhydrazone, 4-diphenylaminobenzaldehyde-1,1-diphenylhydrazone, [p-(diethylamino)phenyl](1-naphthyl) phenylhydrazone, 1-pyrenediphenylhydrazone, 9-ethyl-3-[(2methyl-1-indolinylimino)methyl]carbazole, 4-(2-methyl-1-indolinyliminomethyl)triphenylamine, 9-methyl-3-carbazolediphenylhydrazone, 1,1-di-(4,4'-methoxyphenyl) acrylaldehydediphenylhydrazone, and β,β-bis (methoxyphenyl)vinyldiphenylhydrazone; quinazolines such as 2-phenyl-4-styryl-quinazoline; benzofurans such as 6-hydroxy-2,3-di(p-methoxyphenyl)-benzofuran; α-stilbenes such as p-(2,2-diphenylvinyl)-N,N-diphenylaniline; enamines; carbazoles such as N-ethylcarbazole; poly-N-vinylcarbazole and the derivatives thereof. Examples thereof further include a polymer having a group including any of the above compounds on the main chain or side chain. These charge transport materials may be used solely or in combination of two or more types thereof.

Any binder resin may be used as the binder resin used for the charge transport layer. However, in particular, preferably the binder resin is compatible with the charge transport material and has an appropriate strength.

Examples of this binder resin include: various polycarbonate resins of bisphenol A, bisphenol Z, bisphenol C, bisphenol TP, and the like, and the copolymer thereof; a polyalylate resin and the copolymer thereof; a polyester resin; a methacrylic resin; an acrylic resin; a polyvinylchloride resin; a polyvinylidene chloride resin; a polystyrene resin; a polyvinyl acetate resin; a styrene-butadiene copolymer resin; a vinyl chloride-vinyl acetate copolymer resin; a vinyl chloride-vinyl acetate-maleic anhydride copolymer resin; a silicone resin; a silicone-alkyd resin; a phenol-formaldehyde resin; a styrene-acrylic copolymer resin, an styrene-alkyd resin; a poly-N-vinylcarbazole resin; a polyvinyl butyral resin; and a polyphenylene ether resin. These resins may be used solely, or as a mixture of two or more types thereof.

The molecular weight of the binder resin used for the charge transport layer 2B is appropriately selected according to the film-forming condition such as the thickness of the photosensitive layer 2 and the kind of solvent, and usually it is preferably in the range of from about 3,000 to 300,000 and more preferably from about 20,000 to 200,000 in the viscosity-average molecular weight.

The compounding ratio of the charge transport material to the binder resin may be in the range of from about 10:1 to 1:5.

The charge transport layer 2B and/or the charge generation layer 2A described later may contain additives such as an antioxidant, a photostabilizer, and a thermal stabilizer, in order to prevent the deterioration of the photoreceptor due to ozone or oxidizing gas generated in the image forming device, light, or heat.

Examples of the antioxidant include hindered phenol, hindered amine, paraphenylendiamin, arylalkane, hydroquinone, spirochromans, spiroindanone, or the derivatives thereof, an organic sulfur compound, and an organophosphorus compound.

Specific examples of the compound of the antioxidant include: a phenolic antioxidant such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenylacrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxy-phenyl)propionate]-methane, and 3,9-bis[2-[3-(3-t-butyl-4-hydroxy-5-methylphenyl) propionyloxy]-1,1-dimethylethyl]-2,4,8,10-tetraoxaspiro[5,5]undecane, 3-3',5'-di-t-butyl-4'-hydroxyphenyl)stearyl propionate.

Examples of the hindered amine compound include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, succinic acid dimethyl-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl}{(2,2,6,6-tetramethyl-4-piperidyl) imino}hexamethylene{(2,3,6,6-tetramethyl-4-piperidyl) imino}], 2-(3,5-di-t-butyl-4-hydroxybenzyl)-2-n-butyl malonic acid bis(1,2,2,6,6-pentamethyl-4-piperidyl), and N,N'-bis(3-aminopropyl)ethylenediamine-2,4-bis[N-butyl-N-(1,2,2,6,6,-pentamethyl-4-piperidyl)amino]-6-chloro-1,3,5-triazine condensate.

Examples of the organic sulfur antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

Examples of the organophosphorus antioxidant include trisnonylphenylphosphate, triphenylphosphate, and tris(2,4-di-t-butylphenyl)-phosphate.

The organic sulfur antioxidants and organophosphorus antioxidants are called a secondary antioxidant, which can increase the antioxidative effect synergistically when used with a primary antioxidant such as a phenol or amine.

Examples of the photostabilizer includes benzophenones, benzotriazoles, dithiocarbamates, and tetramethylpiperidines.

Examples of the benzophenone photostabilizer include 2-hydroxy-4-methoxybenzophenone, 2-hydroxy-4-octoxybenzophenone, and 2,2'-di-hydroxy-4-methoxybenzophenone.

Examples of the benzotriazole photostabilizer includes 2-(-2'-hydroxy-5'methylphenyl-)-benzotriazole, 2-[2'-hydroxy-3'-(3",4", 5",6"-tetra-hydrophthalimide-methyl)-5'-methylphenyl]-benzotriazole, 2-(-2'-hydroxy-3'-t-butyl 5'-methylphenyl-)-5-chlorobenzotriazole, 2-(2'-hydroxy-3'-t-butyl-5'-methylphenyl-)-5-chloro benzotriazole, 2-(2'-hydroxy-3',5'-t-butylphenyl-)-benzotriazole, 2-(2'-hydroxy-5'-t-octylphenyl)-benzotriazole, and 2-(2'-hydroxy-3',5'-di-t-amylphenyl-)-benzotriazole.

Examples of other photostabilizers include 2,4, di-t-butylphenyl-3',5'-di-t-butyl-4'-hydroxybenzoate, and nickel dibutyl-dithiocarbamate.

The charge transport layer 2B can be formed by applying and drying a solvent having the charge transport material and the binder resin dissolved in an appropriate solvent. Examples of the solvent used for adjusting the charge transport layer forming coating liquid include: aromatic hydrocarbons, such as benzene, toluene, and chlorobenzene; ketones such as acetone and 2-butanone; halogenated aliphatic hydrocarbons such as methylene chloride, chloroform, and ethylene chloride; cyclic or linear ethers such as tetrahydrofuran, dioxane, ethylene glycol, diethylether; and mixed solvents thereof.

Moreover, the charge transport layer forming coating liquid may be added with a small amount of silicone oil as a leveling agent for improving the smoothness of the coating film formed by coating.

The application of the charge transport layer forming coating liquid can be performed according to the shape and usage of the photoreceptor, by using a method such as a dip coating method, a ring coating method, a spray coating method, a bead coating method, a blade coating method, a roller coating method, a knife coating method, and a curtain coating method. It may be heated and dried after becoming dry to touch at a room temperature. The heating and drying may be performed in a temperature range of 30° C. to 200° C., for 5 minutes to 2 hours.

The film thickness of the charge transport layer 2B may be preferably in a range of 5 μm to 50 μm, and more preferably in a range of 10 μm to 40 μm.

The charge generation layer 2A may be formed by deposition of a charge generating material by a vacuum deposition method, or coating of a solution containing an organic solvent and a binder resin.

As to the charge generating material, there may be used: amorphous selenium, crystalline selenium, selenium-tellurium alloy, selenium-arsenic alloy, and other selenium compounds; an inorganic photoconductor such as selenium alloy, zinc oxide, and titanium oxide; or a dye-sensitized material thereof; various phthalocyanine compound such as metal-free phthalocyanine, titanyl phthalocyanine, copper phthalocyanine, tin phthalocyanine, and galliumphthalocyanine; various organic pigments such as squaryliums, anthanthrones, perylenes, azos, anthraquinones, pyrenes, pyrylium salt, and thia pyrylium salt; or dyes.

Moreover, these organic pigments generally have several types of crystal forms. In particular, for the phthalocyanine compound, various crystal forms are known such as α type and β type. As long as the pigment provides the sensitivity or other characteristics according to the purpose, any of these crystal forms can be used.

Among the abovementioned charge generating materials, phthalocyanine compounds are preferred. In this case, if light is irradiated on the photosensitive layer, the phthalocyanine compound contained in the photosensitive layer absorbs photons and generates carriers. At this time, since the phthalocyanine compound has a high quantum efficiency, the absorbed photons can be efficiently absorbed to generate carriers.

Furthermore, among the phthalocyanine compound, the phthalocyanine as shown in the following (1) to (3) are more preferred. That is:

(1) Hydroxy gallium phthalocyanine of a crystal form having diffraction peaks at least in the positions of 7.6°, 10.0°, 25.2°, and 28.0° in the Bragg angle (2θ±0.2°) of an X-ray diffraction spectrum using Cu kα rays as a charge generating material.

(2) Chlorogallium phthalocyanine of a crystal form having diffraction peaks at least in the positions of 7.3°, 16.5°, 25.4°, and 28.1° in the Bragg angle (2θ±0.2°) of an X-ray diffraction spectrum using Cu kα ray as a charge generating material.

(3) Titanyl phthalocyanine of a crystal form having diffraction peaks at least in the positions of 9.5°, 24.2°, and 27.3° in the Bragg angle (2θ±0.2°) of an X-ray diffraction spectrum using Cu kα ray as a charge generating material.

These phthalocyanine compounds have not only high photosensitivity in particular, but also high stability of the photosensitivity. Therefore, the photoreceptor having the photosensitive layer containing any one of these phthalocyanine compounds may be used as a photoreceptor of a color image forming apparatus which requires high speed image formation and repetitive reproducibility.

Due to the crystal shape and the measurement method, these peak intensity and the position may be slightly out from these values. However, as long as the X-ray diffraction pattern is basically matched, it can be judged to be the same crystal form.

Examples of the binder resin used for the charge generation layer 2A include the following. That is, polycarbonate resins such as bisphenol A type and bisphenol Z type, and the copolymer thereof; a polyalylate resin; a polyester resin; a methacrylic resin; an acrylic resin; a polyvinylchloride resin; a polystyrene resin; a polyvinyl acetate resin; a styrene-butadiene copolymer resin; a vinylidene chloride-acrylnitryl copolymer resin; a vinyl chloride-vinyl acetate-maleic anhydride copolymer resin; a silicone resin; a silicone-alkyd resin; a phenol-formaldehyde resin; styrene-alkyd resin; and a poly-N-vinylcarbazole.

These binder resins may be used solely or in combination of two or more types thereof. The mixing ratio of the charge generation material and the binder resin (charge generation material: binder resin) is desirably within a range between about 10:1 and about 1:10 by weight ratio. Moreover, generally, the thickness of the charge generation layer 2A is preferably in a range of from about 0.01 μm to about 5 μm, and more preferably in a range of from about 0.05 μm to about 2.0 μm.

Moreover, the charge generation layer 2A may contain at least one type of electron accepting material in order to improve the sensitivity, decrease the residual potential, and decrease the fatigue at the time of repetitive usage. Examples of the electron accepting material used for the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferred fluorenones, quinines, and benzenes having an electron attractive substituent such as Cl, CN, and $NO_2$.

As the method of dispersing the charge generating material into a resin, there may be used a method such as a roll mill, a ball mill, a vibratory ball mill, an attritor, a dinomill, a sandmill, and a colloid mill.

Examples of the solvent of the coating liquid for forming the charge generation layer 2A include a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate.

These solvents may be used solely or as a mixture of two or more types. If two or more types of solvents are mixed, any solvent may be used as long as a binder resin can be dissolved therein as a mixed solvent. However, if the photosensitive layer has a layer structure where the charge transport layer 2B and the charge generation layer 2A are formed in this order from the conductive substrate side, when the charge generation layer 2A is formed using an application method such as dip coating in which the lower layer is readily dissolved, a solvent which does not dissolve the lower layer such as the charge transport layer is desirably used. Moreover, when the charge generation layer 2A is formed using a spray coating method or a ring coating method, in which the lower layer is eroded relatively less, the solvent can be widely selected.

As to the intermediate layer 5, for example when the photoreceptor surface is electrified by an electrification device, in order to prevent a situation where the electrification potential can not be obtained by injecting the electrification charges from the photoreceptor surface to the conductive substrate of the photoreceptor serving as the opposed electrode, a charge injection blocking layer may be formed as required between the surface protective layer 3 and the charge generation layer 2A.

As to the material of the charge injection blocking layer, there may be used the abovementioned silane coupling agent, titanium coupling agent, organic zirconium compound, and organic titanium compound, other organometallic compounds, and a widely-used resin such as polyester, and polyvinyl butyral. The thickness of the charge injection blocking layer is appropriately set by considering the film forming property and the carrier blocking property, in a range of from about 0.001 μm to about 5 μm.

(Process Cartridge and Image Forming Device)

Next is a description of the process cartridge and the image forming device using the photoreceptor of an exemplary embodiment of the present invention.

The process cartridge of an exemplary embodiment of the present invention is not specifically limited if the photoreceptor of an exemplary embodiment of the present invention is used. However, specifically, it may be a process cartridge integrally having the photoreceptor of an exemplary embodiment of the present invention and any one selected from the group consisting of an electrification device, a development device, a cleaning device, and an electricity removing device, and being detachable from the image forming device main body.

Moreover, the image forming device of an exemplary embodiment of the present invention is not specifically limited if the photoreceptor of an exemplary embodiment of the present invention is used. However, specifically, it may include the photoreceptor of an exemplary embodiment of the present invention, an electrification device that electrifies this photoreceptor surface, an exposure device that exposes the photoreceptor surface electrified by the electrification device to form an electrostatic latent image, a development device that develops the electrostatic latent image by a developer containing a toner to form a toner image, and a transfer device that transfers the toner image onto a recording medium. The image forming device of an exemplary embodiment of the present invention may be a so-called tandem device which has a multiple photoreceptors corresponding to toners of respective colors. In this case, all photoreceptors may be the photoreceptor of an exemplary embodiment of the present invention. Moreover, the toner image may be transferred by the intermediate transfer method using an intermediate transfer body.

The cleaning device of the process cartridge of an exemplary embodiment of the present invention and the cleaning device of the photoreceptor of the image forming device are not specifically limited. However, the cleaning device may be a cleaning blade. Compared to other cleaning devices, the cleaning blade may often blemish the photoreceptor surface and accelerates the wearing. However, since the process cartridge of an exemplary embodiment of the present invention and the image forming device of an exemplary embodiment of the present invention use the photoreceptor of an exemplary embodiment of the present invention as the photoreceptor, blemishes and wearing on the photoreceptor surface may be suppressed even for long term usage.

Next, the image forming device will be described with reference to a drawing.

Figure 6:
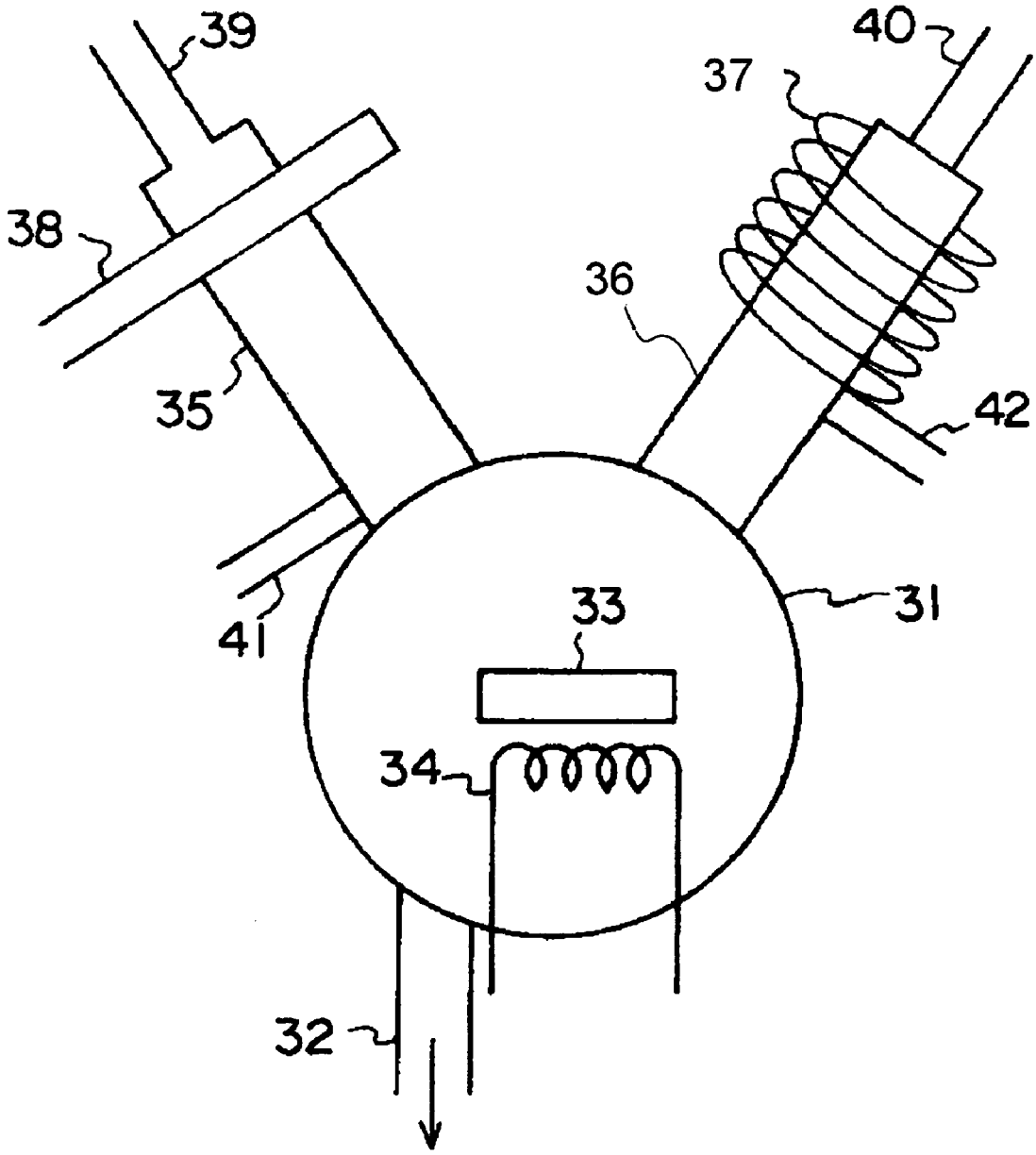
FIG. 6 is a schematic drawing showing an example of the film-forming apparatus.
Figure 7:
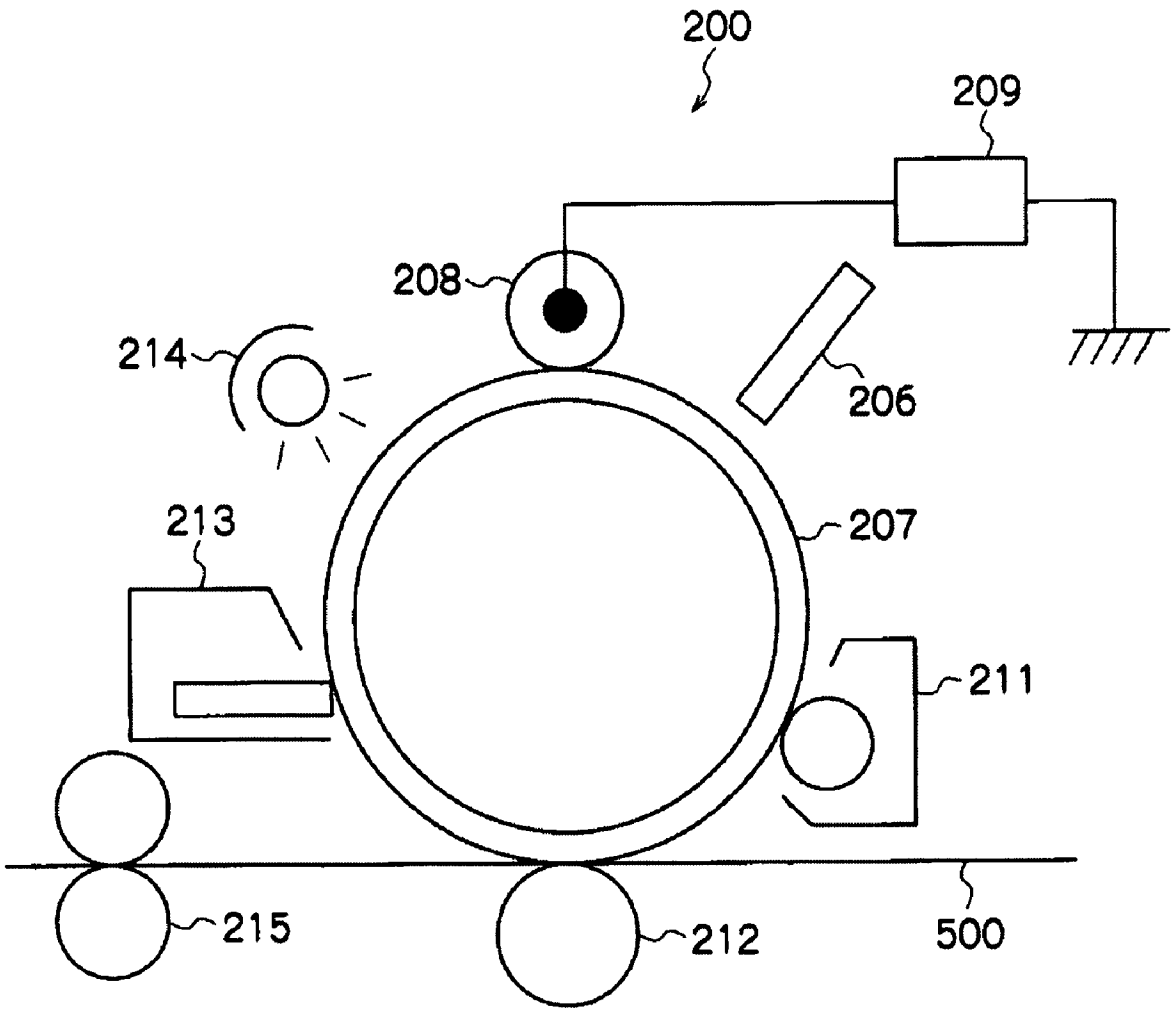
FIG. 7 is a cross section illustrating a basic structure of an image forming device according to an embodiment of the image forming device of an exemplary embodiment of the present invention.

FIG. 7 is a schematic cross-section showing a basic structure of an image forming device of an exemplary of embodiment of the present invention. The image forming device 200 shown in FIG. 6 includes a photoreceptor 207, an electrification device 208 that electrifies the photoreceptor 207, a power source 209 that is connected to the electrification device 208, an exposure device 206 that exposes the photoreceptor 207 electrified by the electrification device 208 to form an electrostatic latent image, a development device 211 that develops the electrostatic latent image formed by the exposure device 206 by a toner to form a toner image, a transfer device 212 that transfers the toner image formed by the development device 211 onto a transfer body (image output medium) 500, a cleaning device 213, an electricity removing device 214, and a fixing device 215. In this case, the electricity removing device 214 may not be included in the image forming device.

Figure 8:
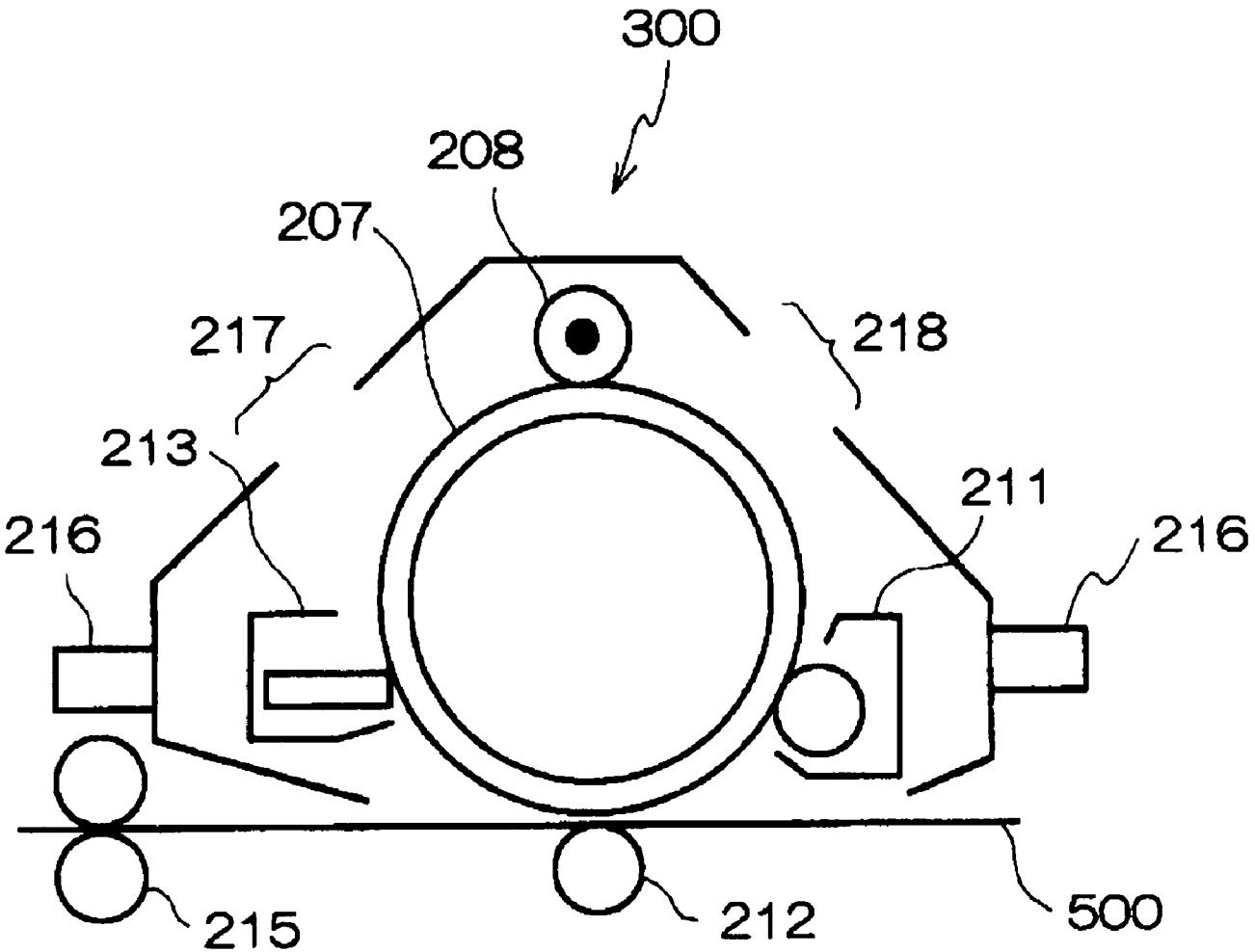
FIG. 8 is a cross section illustrating an embodiment of a process cartridge of an exemplary embodiment of the present invention.

FIG. 8 is a schematic cross-section showing an example of a process cartridge of an exemplary embodiment of the present invention. In the process cartridge 300, a photoreceptor 207, an electrification device 208, a development device 211, a cleaning device (cleaning means) 213, an opening 218 for exposure, and an opening 217 for electricity removing are combined by using a fixing rail 216, and integrated. The photoreceptor 207 may include a photosensitive layer containing hydroxygallium phthalocyanine. The development device 211 supplies the photoreceptor 207 with a toner.

The process cartridge 300 is detachable from the image forming device main body including a transfer device 212, a fixing device 215, and other component parts which are not shown, and may be included in the image forming device together with the image forming device main body.

EXAMPLES

Hereunder is a specific description of exemplary embodiments of the present invention with reference to Examples. However, the present invention is not limited to these Examples.

Example 1

(Manufacture of Electrophotographic Photoreceptor)

Firstly, in the procedure described below, an organic photoreceptor where on the Al substrate is laminated the under coating layer, the charge generation layer, and the charge transport layer (organic photosensitive layer) in this order, is produced.

-Formation of Under Coating Layer-

A solution obtained by stirring and mixing 20 parts by weights of zirconium compound (trade name: ORGATICS ZC540, made by Matsumoto Chemical Industry Co., Ltd.), 2.5 parts by weights of silane compound (trade name: A1100, made by Nippon Unicar Company Limited), 10 parts by weights of polyvinyl butyral resin (trade name: S-LEC BM-S made by Sekisui Chemical Co., Ltd.), and 45 parts by weights of butanol is coated on the surface of the Al substrate having an outer diameter of 84 mm, and heated and dried at 150° C. for 10 minutes, and thereby the under coating layer having a thickness of 1.0 μm is formed.

—Formation of Charge Generation Layer—

Next, a mixture obtained by mixing 1 part by weights of chlorogallium phthalocyanine as the charge generating material, 1 part by weights of polyvinyl butyral (trade name: S-LEC BM-S made by Sekisui Chemical Co., Ltd.), and 100 parts by weights of n-butylacetate is dispersed with glass beads and a paint shaker for 1 hour, and a charge generation layer forming dispersion is obtained.

This dispersion is applied on the under coating layer by the dip coating method, and then dried at 100° C. for 10 minutes, to form a charge generation layer having a thickness of 0.15 μm.

—Formation of Charge Transport Layer—

Next, 2 parts by weights of the compound represented by the structural formula (1) below and 3 parts by weights of the polymeric compound (volume average molecular weight: 39000) represented by the structural formula (2) below are dissolved in 20 parts by weights of chlorobenzene, and the charge transport layer forming coating liquid is obtained.

Structural formula (1)

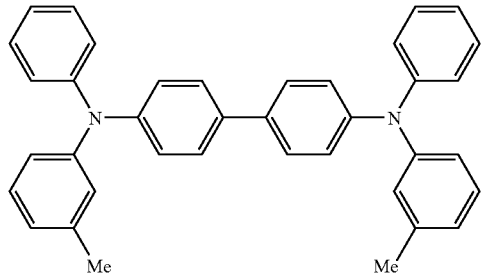

-continued

Structural formula (2)

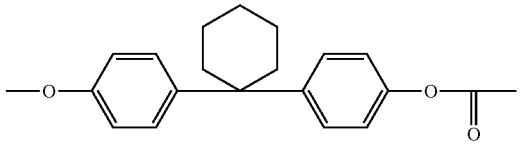

This coating liquid is applied on the charge generation layer by the dip coating method, and heated at 110° C. for 40 minutes, to form a charge transport layer having a thickness of 20 μm. By so doing, an organic photoreceptor (hereunder, also called a "noncoat photoreceptor") where on the Al substrate is laminated the under coating layer, and the charge generation layer and the charge transport layer (organic photosensitive layer) in this order, is obtained.

—Formation of Surface Layer—

The surface layer is formed on the noncoat photoreceptor surface using the film-forming apparatus having the structure shown in FIG. 4A and FIG. 4B.

Firstly, the noncoat photoreceptor having a diameter of 84 mm and a length of 340 mm is mounted on the substrate holder 13 in the film formation chamber 10 of the film-forming apparatus, and inside of the film formation chamber 10 is evacuated through the outlet 11 until the pressure becomes about 0.05 Pa. Next, about 300 sccm of a gas in which a nitrogen gas and a hydrogen gas are mixed at a ratio of 1:2 (nitrogen gas 100 sccm and hydrogen gas 200 sccm) is introduced from the gas introduction pipe 20 into the high frequency discharge pipe portion 21 provided with the electrode 19 having a diameter of 50 mm, and a radiofrequency wave is discharged from the electrode 19 by setting radiofrequency waves of 13.56 MHz to an output of 100 W with matching with a tuner using the high frequency power supply section 18 and a matching circuit (not shown in FIG. 1). The reflected wave at this time is 0 W.

Next, a mixed gas containing a trimethylgallium gas having a hydrogen gas as a carrier gas is introduced through the gas introduction pipe 15 from the shower nozzle 16 into the plasma diffusion portion 17 in the film formation chamber 10 so that the flow rate of the trimethylgallium gas is 3 sccm. At this time, the reaction pressure in the film formation chamber 10 measured by a BARATRON vacuum gauge (manufactured by MKS Instrument, Inc) is 40 Pa.

In this state, by carrying out of film formation for 60 minutes while rotating the noncoat photoreceptor at a speed of 2 rpm, a GaN film having a thickness of 0.15 μm is formed, to obtain the organic photoreceptor provided with the surface layer on the surface of the charge transport layer. No heat is applied to the noncoat photoreceptor for forming the film. Moreover, the color of the thermo tape that has been previously adhered on the surface of the noncoat photoreceptor under the same conditions as those the film formation, is confirmed after the film formation, to be 45° C.

The surface roughness of the photoreceptor thus obtained is measured by using a surface roughness meter (trade name: SURFCOM 550A, manufactured by TOKYO SEIMITSU Co., Ltd.). Specifically, the center line average roughness (Ra) is obtained by measuring 10 positions with a measuring length of 1.0 mm in the axial direction of the photoreceptor to obtain the average value. As a result, the center line average roughness (Ra) is 0.02 μm.

—Analysis and Evaluation of Surface Layer—

A layer is formed on a Si substrate in the same manner as in the formation of the surface layer on the non-coat photoreceptor, and IR absorption spectra of the layer on the Si substrate are measured. Peaks assigned to Ga—H, Ga—N and N—H bonds are confirmed from the measurement. These results show that the surface layer contains gallium, nitrogen and hydrogen. The half-width of the Ga—N absorption peak is 130 $cm^{-1}$.

While Ga and N as well as 20 atomic % of oxygen are detected at a depth of 10 nm from the surface from the measurement of the composition by Rutherford back scattering, the abundance ratio of Ga and N is 0.45:0.55 at the position deeper than the above-mentioned position. The hydrogen content in the layer is found to be 15 atomic % from HFS (hydrogen forward scattering), and diffused rings are observed in the diffraction image obtained by RHEED (reflection high energy electron diffraction). This result shows that micro crystals are intermingled in the amorphous part, or the particle diameter of the micro crystals is about 50 Å .

While traces of dissolution with water is seen on the layer formed on the Si substrate immediately after formation by dipping the substrate in water, the layer after allowing to stand for 1 day in an environment of atmospheric pressure and room temperature is not dissolved by dipping in water, and no flaws are found on the surface by rubbing with stainless steel.

The results of above-mentioned analysis and evaluation indicate that the surface layer is a microcrystalline amorphous layer with a composition containing hydrogen, nitrogen and gallium as well as oxygen. The surface layer has a concentration distribution of oxygen in which oxygen is most abundant at the uppermost surface and the concentration of oxygen decreases toward the charge transport layer side.

(Evaluation)

Electrophotographic characteristics of the electrophotographic photosensitive layer having the surface layer are evaluated.

A non-coat photoreceptor which has not been provided with the surface layer and a photoreceptor having the surface layer is negatively charged with a Scorotron electrifier at −700 V, and the surface of the photoreceptor is scanned using exposure light (light source: semiconductor laser, wavelength: 780 nm, output: 5 mW) while the photoreceptor is rotating at 40 rpm to measure the residual potential after irradiation. The result shows that, while the residual potential on the non-coat photoreceptor is −20 V, the electrophotographic photoreceptor having the surface layer has comparable residual potential of −25 V or lower, which is a good level without any dependency on the temperature and humidity.

While the effect of the surface layer on sensitivity is evaluated in the wavelength range of the light source from the IR region to the visible region, substantially no difference is observed between the non-coat photoreceptor and the photoreceptor having the surface layer. This result shows that the sensitivity does not decrease by providing the surface layer.

When a peel test by which an adhesive tape adhered on the surface of the photoreceptor having the surface layer is peeled is performed, the surface layer of the photoreceptor is not peeled at all, and adhesiveness of the surface layer is shown to be excellent.

The photoreceptor having the surface layer is mounted on a process cartridge for DOCUCENTRE COLOR 500 (trade name, manufactured by Fuji Xerox Co., Ltd.), and the cartridge is attached to DOCUCENTRE COLOR 500 for evaluation of continuous printing on 10000 sheets under a high-temperature high-humidity environment (28° C., 80% RH).

The non-coat photoreceptor is attached to DOCUCENTRE COLOR 500 as a reference for evaluation of the image quality, and images are formed as described above.

The result shows that the images formed by using the photoreceptor having the surface layer at the beginning and after the end of the printing test are as clear as the image formed by using the non-coat photoreceptor at the beginning of the test as a reference. No blur of dot images is found, resolution is 10 lines/mm, and neither decrease of image density nor irregular images due to imperfect cleaning is observed in the images obtained by using the photoreceptor having the surface layer. Neither decrease of the image density nor fogging on the background due to repeated printing is seen even after 10000 sheets of printing.

No flaws are found by visual observation of the surface of the photoreceptor after the printing test, wear of the layer is 0.0 μm from the measurement of the thickness, and no adhesion of discharge products is confirmed. The surface has good slidability with low friction as determined by a qualitative test of rubbing the surface with a paper towel. On the other hand, the non-coat photoreceptor as a reference showed many flaws on the surface of photoreceptor after the printing test with an amount of wear of 0.3 μm.

The results show that durability is improved when the photoreceptor having the surface layer is used, and the image quality such as sensitivity and blur of the image is at a practically acceptable level.

Example 2

(Manufacture of Electrophotographic Photoreceptor)

—Formation of Surface Layer—

The surface layer is formed on the surface of the non-coat photoreceptor manufactured in Example 1 using the film-forming apparatus having the structure shown in FIGS. 4A and 4B.

The non-coat photoreceptor is placed on the substrate holder 13 in the film formation chamber 10 of the film-forming apparatus, and the inside of the film formation chamber 10 is evacuated to about 0.05 Pa through the outlet 11. Then, a mixed gas of nitrogen gas and hydrogen gas in 1:2 ratio (volume ratio) is introduced into a high frequency discharge pipe portion 21 in which an electrode 19 with a diameter of 50 mm is provided at a rate of 600 sccm (nitrogen gas: 200 sccm, hydrogen gas: 400 sccm) through a gas introduction pipe 20, and a radiofrequency wave with a frequency of 13.56 MHz is discharged from the electrode 19 by setting the output energy at 300 W with matching with a tuner using the high frequency power supply section 18 and a matching circuit (not shown in FIG. 1). The energy of the reflection wave is 0 W.

Subsequently, a mixed gas containing trimethyl aluminum gas is introduced into a plasma diffusion portion 17 in the film formation chamber 10 from a shower nozzle 16 through a gas introduction pipe 15 using hydrogen gas as a carrier gas so that the flow rate of trimethyl aluminum gas is 3 ccm. The reaction pressure in the film formation chamber 10 as measured with a BARATRON vacuum gauge (manufactured by MKS Instrument, Inc) is 40 Pa.

The formation of surface layer is carried out for 60 minutes while the non-coat photoreceptor is rotated at 2 rpm to form an AlN layer with a thickness of 0.15 μm, and the electrophotographic photoreceptor having a surface layer on the surface of the charge transport layer is obtained. The non-coat photoreceptor is not subjected to heat treatment for depositing the layer. The color of a thermo-tape, which is adhered on the surface of the non-coat photoreceptor under the same condition as formation of the layer in advance in an independent run, is also observed after deposition of the layer, and the temperature is confirmed to be 55° C.

The surface roughness of the photoreceptor is measured by using a surface roughness meter (trade name: SURFCOM 550A, manufactured by TOKYO SEIMITSU Co., Ltd.). Specifically, the center line average roughness (Ra) is obtained by measuring 10 positions with a measuring length of 1.0 mm in the axial direction of the photoreceptor to obtain the average value. As a result, the center line average roughness (Ra) is 0.05 μm.

—Analysis and Evaluation of Surface Layer—

A layer is formed on a Si substrate in the same manner as in the formation of the surface layer on the non-coat photoreceptor, and peaks assigned to Al—H, Al—N and N—H bonds are confirmed by IR absorption spectra of the layer formed on the Si substrate. This means that aluminum, nitrogen and hydrogen are contained in the surface layer. The half-width of the Al—N absorption peak is 200 $cm^{-1}$.

While Al and N as well as 10 atomic % of oxygen are detected at a depth of 10 nm from the surface by the measurement of Rutherford back scattering, the abundance ratio of Al and N is 0.48:0.52 at the position deeper than the above-mentioned position. The hydrogen content in the layer is found to be 15 atomic % from the measurement of HFS (hydrogen forward scattering), and diffused rings are observed in the diffraction image obtained by RHEED (reflection high energy electron diffraction) measurement. This result shows that micro crystals are intermingled in the amorphous part, or the particle diameter of the micro crystals is about 50 Å . No flaws are observed on the layer formed on the Si substrate when the surface is rubbed with stainless steel.

The results of above-mentioned analysis and evaluation indicate that the surface layer is a microcrystalline amorphous layer with a composition containing hydrogen, nitrogen and aluminum as well as oxygen. The surface layer has a concentration distribution of oxygen in which oxygen is most abundant at the uppermost surface and the concentration of oxygen decreases toward the charge transport layer side.

(Evaluation)

Electrophotographic characteristics of the organic photoreceptor having the surface layer are evaluated.

A non-coat photoreceptor before providing the surface layer and the photoreceptor having the surface layer are negatively charged with a Scorotron electrifier at −700 V, and the surface of the photoreceptor is scanned using exposure light (light source: semiconductor laser, wavelength: 780 nm, output: 5 mW) while the photoreceptor is rotating at 40 rpm to measure residual potential after irradiation. The result shows that, while the residual potential on the non-coat photoreceptor is −20 V, the electrophotographic photoreceptor having the surface layer has comparable residual potential of −30 V or lower, which is a good level without any dependency on the temperature and humidity.

The effect on sensitivity is evaluated with a wavelength of the light source in an entire range of from IR to visible ranges, and substantially no difference is observed between the non-coat photoreceptor and the photoreceptor having the surface layer. It is also found that the sensitivity is not substantially decreased by providing the surface layer.

When a peel test by which an adhesive tape adhered on the surface of the photoreceptor having the surface layer is peeled is performed, the surface layer of the photoreceptor is not peeled at all, and adhesiveness of the surface layer is shown to be excellent.

The photoreceptor having the surface layer is mounted on a process cartridge for DOCUCENTRE COLOR 500 (trade name, manufactured by Fuji Xerox Co., Ltd.), and the cartridge is attached to DOCUCENTRE COLOR 500 for evaluation of continuous printing on 10000 sheets under a high-temperature high-humidity environment (28° C., 80% RH). The non-coat photoreceptor is also attached to DOCUCENTRE COLOR 500 as a reference for evaluation of the image quality, and images are formed as described above.

The result shows that the images formed by using the photoreceptor having the surface layer at the beginning and after the end of the printing test are as clear as the image formed by using the non-coat photoreceptor at the beginning of the test as a reference. No blur of dot images is found, resolution is 10 lines/mm, and neither decrease of image density nor irregular images due to imperfect cleaning is observed in the images obtained by using the photoreceptor having the surface layer. Neither decrease of the image density nor fogging on the background due to repeated printing is seen even after 10000 sheets of printing.

No flaws are found by visual observation of the surface of the photoreceptor after the printing test, wear of the layer is 0.0 μm from the measurement of the thickness, and no adhesion of discharge products is confirmed. The surface has good slidability with low friction as determined by a qualitative test of rubbing the surface with a paper towel. On the other hand, the non-coat photoreceptor as a reference showed many flaws on the surface of photoreceptor after the printing test with an amount of wear of 0.3 μm.

The results show that durability is improved when the photoreceptor having the surface layer is used, and the image quality such as sensitivity and blur of the image is at a practically acceptable level.

Example 3

(Manufacture of Electrophotographic Photoreceptor)

—Formation of Surface Layer—

The surface layer is formed on the surface of the non-coat photoreceptor manufactured in Example 1 using the film-forming apparatus having the structure shown in FIGS. 4A and 4B. Specifically, the concentration of hydrogen gas in the mixed gas in Example 1 is decreased.

The non-coat photoreceptor is placed on the substrate holder 13 in the film formation chamber 10 of the film-forming apparatus, and the inside of the film formation chamber 10 is evacuated to about 0.05 Pa through an outlet 11. Then, a mixed gas of nitrogen gas and 5% by volume of hydrogen gas is introduced into a high frequency discharge pipe portion 21 in which an electrode 19 with a diameter of 50 mm is provided through a gas introduction pipe 20 at a rate of 1000 sccm, and a radiofrequency wave with a frequency of 13.56 MHz is discharged from the electrode 19 by setting the output energy at 300 W with matching with a tuner using the high frequency power supply section 18 and a matching circuit (not shown in FIG. 1). The energy of the reflection wave is 0 W.

Subsequently, a mixed gas containing trimethylgallium gas is introduced into a plasma diffusion portion 17 in the film formation chamber 10 from a shower nozzle 16 through a gas introduction pipe 15 using hydrogen gas as a carrier gas so that the flow rate of trimethylgallium gas is 3 sccm. The reaction pressure in the film formation chamber 10 as measured with a BARATRON vacuum gauge (manufactured by MKS Instrument, Inc) is 40 Pa.

Formation of the surface layer is carried out for 1 hour while the non-coat photoreceptor is rotated at 2 rpm to form a GaN layer with a thickness of 0.1 μm, and the electrophotographic photoreceptor having a surface layer on the surface of the charge transport layer is obtained. The non-coat photoreceptor is not subjected to heat treatment for forming the layer. The color of a thermo-tape, which is adhered on the surface of the non-coat photoreceptor under the same condition as formation of the layer in advance in an independent run, is also observed after formation of the layer, and the temperature is confirmed to be 60° C.

The surface roughness of the photoreceptor is measured by using a surface roughness meter (trade name: SURFCOM 550A, manufactured by TOKYO SEIMITSU Co., Ltd.). Specifically, the center line average roughness (Ra) is obtained by measuring 10 positions with a measuring length of 1.0 mm in the axial direction of the photoreceptor to obtain the average value. As a result, the center line average roughness (Ra) is 0.05 μm.

—Analysis and Evaluation of Surface Layer—

A layer is formed on a Si substrate in the same manner as in the formation of the surface layer on the non-coat photoreceptor, and IR absorption spectra of the layer formed on the Si substrate is measured. The absorption peaks of NH and OH are strong in the IR absorption spectrum, and the absorption peak of GaN is broad with a width of 270 $cm^{-1}$.

(Evaluation)

Electrophotographic characteristics of the organic photoreceptor having the surface layer are evaluated.

The surfaces of the non-coat photoreceptor before depositing the surface layer and the photoreceptor having the surface layer are irradiated with exposure light by the same method as in Example 1, and residual potential on the surface is measured. The result shows that, while the residual potential on the non-coat photoreceptor is −20 V, the electrophotographic photoreceptor having the surface layer has comparable residual potential of −30 V, and the residual potential is practically of no problem.

The surface layer on the photoreceptor having the surface layer is not peeled at all in a peeling test by peeling an adhesive tape on the surface layer, and adhesivity is shown to be excellent.

The photoreceptor having the surface layer is mounted on a process cartridge for DOCUCENTRE COLOR 500 (trade name, manufactured by Fuji Xerox Co., Ltd.), and the cartridge is attached to DOCUCENTRE COLOR 500 for evaluation of continuous printing by the same method as in Example 1.

The result shows that the images formed by using the surface-coated photoreceptor at the beginning and after the end of the printing test are as clear as the image formed by using the non-coat photoreceptor at the beginning. No blur of dot images is found, resolution is 10 lines/mm, and neither decrease of image density nor irregular images due to imperfect cleaning is observed in the images obtained by using the photoreceptor having the surface layer. However, the dot image is a little blurred as compared with the image at the initial stage of the print test using the non-coat photoreceptor. The surface is slightly damaged after 5000 times of printing, and durability seems to be a little bit insufficient.

Example 4

(Manufacture of Electrophotographic Photoreceptor)

—Formation of Surface Layer—

The surface layer is formed on the surface of the non-coat photoreceptor manufactured in Example 1 using the film-forming apparatus having the structure shown in FIGS. 4A and 4B. Specifically, the concentration of hydrogen gas in the mixed gas in Example 1 is increased.

The non-coat photoreceptor is placed on the substrate holder 13 in the film formation chamber 10 of the film-forming apparatus, and the inside of the film formation chamber 10 is evacuated to about 0.05 Pa through an outlet 11. Then, a mixed gas of nitrogen gas and 98% by volume of hydrogen gas is introduced into a high frequency discharge pipe portion 21 in which an electrode 19 with a diameter of 50 mm is provided at a rate of 1000 sccm through the gas introduction pipe 20, and a radiofrequency wave with a frequency of 13.56 MHz is discharged from the electrode 19 by setting the output energy at 300 W with matching with a tuner using the high frequency power supply section 18 and a matching circuit (not shown in FIG. 1). The energy of the reflection wave is 0 W.

Subsequently, a mixed gas containing trimethylgallium gas is introduced into a plasma diffusion portion 17 in the film formation chamber 10 from a shower nozzle 16 through a gas introduction pipe 15 using hydrogen gas as a carrier gas so that the flow rate of trimethylgallium gas is 3 sccm. The reaction pressure in the film formation chamber 10 as measured with a BARATRON vacuum gauge (manufactured by MKS Instrument, Inc) is 40 Pa.

Formation of the surface layer is carried out for 1 hour while the non-coat photoreceptor is rotated at 2 rpm to form a GaN layer with a thickness of 0.07 μm, and the organic photoreceptor having a surface layer on the surface of the charge transport layer is obtained. The color of the surface changes to brown. The non-coat photoreceptor is not subjected to heat treatment for forming the layer. The color of a thermo-tape, which is adhered on the surface of the non-coat photoreceptor under the same condition as formation of the layer in advance in an independent run, is also observed after formation of the layer, and the temperature is confirmed to be 40° C.

The surface roughness of the photoreceptor is measured by using a surface roughness meter (trade name: SURFCOM 550A, manufactured by TOKYO SEIMITSU Co., Ltd.). Specifically, the center line average roughness (Ra) is obtained by measuring 10 positions with a measuring length of 1.0 mm in the axial direction of the photoreceptor to obtain the average value. As a result, the center line average roughness (Ra) is 0.07 μm.

—Analysis and Evaluation of Surface Layer—

A layer is formed on a Si substrate in the same manner as in the formation of the surface layer on the non-coat photoreceptor, and IR absorption spectra of the layer formed on the Si substrate are measured. Peaks assigned to N—H, Ga—H and Ga—N absorptions are observed from the measurement. The half-width of the Ga—N absorption peak is 200 $cm^{-1}$.

(Evaluation)

Electrophotographic characteristics of the electrophotographic photoreceptor having the surface layer are evaluated.

Exposure light is irradiated on the surface of the non-coat photoreceptor before providing the surface layer and on the surface of the photoreceptor having the surface layer by the same method as in Example 1, and residual potential on the surface is measured. While the residual potential on the non-coat photoreceptor is −20 V, the residual potential on the electrophotographic photoreceptor having the surface layer is −70 V, which is a little higher than that of the non-coat photoreceptor.

While an adhesive tape adhered on the surface of the photoreceptor having the surface layer is peeled for a peeling test, the surface layer is not peeled at all and adhesiveness of the surface layer is shown to be excellent.

The photoreceptor having the surface layer is mounted on a process cartridge for DOCUCENTRE COLOR 500 (trade name, manufactured by Fuji Xerox Co., Ltd.), and the cartridge is attached to DOCUCENTRE COLOR 500 for evaluation of continuous printing by the same method as in Example 1.

The result shows that the image density of the photoreceptor having the surface layer is slightly decreased as compared with the image at the initial stage of the print test formed using the non-coat photoreceptor. Faint stripes of flaws are seen on the surface layer after 5000 times of printing, and durability is shown to be a little bit insufficient.

Comparative Example 1

—Formation of Surface Layer—

The surface layer is formed on the non-coat photoreceptor manufactured in Example 1 using a film-forming apparatus shown in FIG. 6 in which a microwave discharge tube is added to the film-forming apparatus shown in FIGS. 4A and 4B.

FIG. 6 is a schematic illustration of an apparatus used for a plasma activation MOCVD method. A thin layer is formed by means of activation of plasma by the plasma activation MOCVD method. In FIG. 6, the reference numeral 31 denotes a vessel capable of evacuation, the reference numeral 32 denotes an outlet, the reference numeral 33 denotes a substrate holder, the reference numeral 34 denotes a heater for heating the substrate, and the reference numerals 35 and 36 denote silica tubes connected to the vessel 31. The silica tubes communicate with gas introduction pipes 39 and 40, respectively. A gas introduction pipe 41 is connected to the silica tube 35, and a gas introduction pipe 42 is connected to the silica tube 36.

A non-coat photoreceptor is mounted on a substrate holder (not shown) in a vessel 31 of the film-forming apparatus, and the vessel 31 is evacuated to a pressure of about 0.05 Pa through the outlet 32. Then, nitrogen gas is introduced into the silica tube 35 from a introduction pipe 39 at a rate of 1000 sccm, and a microwave with a frequency of 13.56 MHz is applied through a microwave guide 38 at a microwave energy of 300 W. Hydrogen is introduced from a gas introduction pipe 40 at a rate of 1000 sccm, and microwave at a frequency of 2.45 GHz is supplied to a high frequency coil 37 at a microwave energy of 100 W for electric discharge in the silica tube 36.

A mixed gas containing trimethylgallium gas is introduced into the vessel 31 through the gas introduction pipe 41 using hydrogen gas as a carrier gas so that the flow rate of the trimethylgallium gas is 3 sccm. The reaction pressure measured with a BARATRON vacuum gauge (manufactured by MKS Instrument, Inc) is 40 Pa. The vessel is not heated.

Formation of the surface layer is carried out for 1 hour while the non-coat photoreceptor is rotated at 2 rpm to form a GaN layer with a thickness of 0.07 μm, and the electrophotographic photoreceptor having a surface layer on the surface of the charge transport layer is obtained. The color of the surface changes to brown, and the surface is shown to be shrunk with fine wrinkles. The non-coat photoreceptor is not subjected to heat treatment for depositing the layer. The color of a thermo-tape, which is adhered on the surface of the non-coat photoreceptor under the same condition as formation of the layer in advance in an independent run, is also observed after formation of the layer, and the temperature is confirmed to be 155° C. The surface layer of the organic photosensitive layer is supposed to be melted since the surface temperature increases by irradiating plasma only.

The surface roughness of the photoreceptor is measured by using a surface roughness meter (trade name: SURFCOM 550A, manufactured by TOKYO SEIMITSU Co., Ltd.). Specifically, the center line average roughness (Ra) is obtained by measuring 10 positions with a measuring length of 1.0 mm in the axial direction of the photoreceptor to obtain the average value. As a result, the center line average roughness (Ra) is 0.20 μm.

A layer is formed on a Si substrate in the same manner as in the formation of the surface layer on the non-coat photoreceptor, and IR absorption spectra of the layer formed on the Si substrate are measured. Peaks assigned to N—H, Ga—H and Ga—N absorptions are observed from the measurement. The half-width of the Ga—N absorption peak is 250 $cm^{-1}$.

(Evaluation)

Characteristics of the electrophotographic image of the organic photoreceptor having the surface layer are evaluated.

The photoreceptor having the surface layer is attached to DOCUCENTRE COLOR 500 (trade name, manufactured by Fuji Xerox Co., Ltd.), and the photoreceptor is subjected to the evaluation of printing as in Example 1. Incidence of defective cleaning is found with adhesion of the toner on the entire surface of the photosensitive layer from observation of the surface of the photoreceptor after several sheets of printing. The density of the image is low with low resolution, and the photoreceptor is not practically acceptable.

Comparative Example 2

(Manufacture of Electrophotographic Photoreceptor)

—Formation of Surface Layer—

The surface layer is formed under the same condition as in Comparative Example 1 using the non-coat photoreceptor manufactured in Example 1, except that no high frequency discharge is applied.

The non-coat photoreceptor is placed as described in Comparative Example 1, and an electrophotographic photoreceptor having a surface layer on the surface of the charge transport layer is obtained by forming a GaN layer for 1 hour to a thickness of 0.08 μm while the non-coat photoreceptor is rotating at a rotation speed of 2 rpm, except that the microwave is not supplied to the microwave guide 38 and high frequency coil 37. The color of the surface turned to brown, and the surface is shown to be shrunk with fine wrinkles. The non-coat photoreceptor is not heated for formation of the layer. The color of a thermo-tape adhered on the surface of the non-coat photoreceptor in advance under the same condition as formation of the layer in an independent run is confirmed after formation of the layer, and the temperature of the surface is found to be 145° C. The surface of the organic layer is supposed to be melted since the surface temperature increases by irradiating plasma only.

The surface roughness of the photoreceptor is measured by using a surface roughness meter (trade name: SURFCOM 550A, manufactured by TOKYO SEIMITSU Co., Ltd.). Specifically, the center line average roughness (Ra) is obtained by measuring 10 positions with a measuring length of 1.0 mm in the axial direction of the photoreceptor to obtain the average value. As a result, the center line average roughness (Ra) is 0.15 μm.

A layer is formed on a Si substrate in the same manner as in the formation of the surface layer on the non-coat photoreceptor, and IR absorption spectra of the layer formed on the Si substrate are measured. Peaks assigned to N—H, Ga—H and Ga—N absorptions are observed from the measurement. The half-width of the Ga—N absorption peak is 280 $cm^{-1}$.

(Evaluation)

Subsequently, characteristics of the electrophotographic image of the organic photoreceptor having the surface layer are evaluated.

The photoreceptor having the surface layer is attached to DOCUCENTRE COLOR 500 (trade name, manufactured by Fuji Xerox Co., Ltd.), and the photoreceptor is subjected to the printing test as in Example 1. Incidence of defective cleaning with adhesion of the toner on the entire surface of the surface layer is seen from observation of the surface of the photoreceptor after several sheets of printing. The density of the image is low with low resolution, and the photoreceptor is not practically acceptable.

Comparative Example 3

(Manufacture of Electrophotographic Photoreceptor)

—Formation of Surface Layer—

The surface layer is formed under the same condition as in Comparative Example 1 using the non-coat photoreceptor manufactured in Example 1, except that the formation time is prolonged.

The non-coat photoreceptor is placed under the same condition as in Comparative Example 1, and the vessel 31 is evacuated to a pressure of about 0.05 Pa through the outlet 32. Then, nitrogen gas is introduced into the silica tube 35 through the introduction pipe 39 at 1000 sccm, and microwave at a frequency of 13.56 MHz is applied through the microwave guide 38 at an energy of 300 W. Hydrogen is introduced from the gas introduction pipe 40 at a rate of 1000 sccm, and electric discharge is generated in the silica tube 36 by applying microwave at a frequency of 2.45 GHz with an energy of 100 W to the high frequency coil 37.

A mixed gas containing trimethylgallium gas is introduced into the vessel 31 through the gas introduction pipe 41 using hydrogen gas as a carrier gas so that the flow rate of the trimethylgallium gas is 10 sccm. The reaction pressure in the vessel 31 measured with a BARATRON vacuum gauge (manufactured by MKS Instrument, Inc) is 40 Pa. The vessel is not heated.

An electrophotographic photoreceptor having a surface layer on the surface of the charge transport layer is obtained by formation of a GaN layer for 3 hour to a thickness of 1.1 μm while the non-coat photoreceptor is rotating at a rotation speed of 2 rpm. The color of the surface turned to brown, and the surface is roughened and shown to be shrunk with bold wrinkles. The non-coat photoreceptor is not heated for deposition of the layer.

The color of a thermo-tape adhered on the surface of the non-coat photoreceptor in advance under the same condition as deposition of the layer in an independent run is confirmed after deposition of the layer, and the temperature of the surface is found to be 170° C. The surface of the organic layer is supposed to be melted since the surface temperature increases by irradiating plasma only.

The surface roughness of the photoreceptor is measured by using a surface roughness meter (trade name: SURFCOM 550A, manufactured by TOKYO SEIMITSU Co., Ltd.). Specifically, the center line average roughness (Ra) is obtained by measuring 10 positions with a measuring length of 1.0 mm in the axial direction of the photoreceptor to obtain the average value. As a result, the center line average roughness (Ra) is 0.4 μm.

A layer is formed on a Si substrate in the same manner as in the formation of the surface layer on the non-coat photoreceptor, and IR absorption spectra of the layer formed on the Si substrate are measured. Peaks assigned to N—H, Ga—H and Ga—N absorptions are observed from the measurement. The half-width of the Ga—N absorption peak is 280 $cm^{-1}$.

(Evaluation)

Characteristics of the electrophotographic image of the organic photoreceptor having the surface layer are evaluated.

The photoreceptor having the surface layer is attached to DOCUCENTRE COLOR 500 (trade name, manufactured by Fuji Xerox Co., Ltd.), and the photoreceptor is subjected to the printing test as in Example 1. Incidence of defective cleaning with adhesion of the toner on the entire surface of the surface layer is seen from observation of the surface of the photoreceptor after several sheets of printing. The density of the image is low with low resolution, and the photoreceptor is not practically acceptable.

As shown by the above-mentioned results, the electrophotographic photoreceptor in which the surface layer is formed so that the formation temperature is less than 100° C. is excellent in smoothness of the surface as compared with the conventional photoreceptor formed as a high temperature. The photoreceptor of an exemplary embodiment of the present invention is also excellent in ware durability and in the effect for suppressing discharge products from adhering on the surface, while the photoreceptor of an exemplary embodiment of the present invention is highly durable and is able to form high quality images.

The foregoing description of the embodiments of an aspect of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising:

a photosensitive layer including a charge transport layer, and a surface layer laminated on a conductive substrate in this order, the surface layer being located on or above the charge transport layer;

the photosensitive layer includes an organic substance; and the surface layer comprises nitrogen, at least one element selected from the group consisting of Ga and In, and hydrogen in a range of from 0.1 atomic % to 50 atomic %, wherein a thickness of the surface layer is from about 0.01 μm to less than about 1 μm, a center line average roughness (Ra) of a surface of the surface layer is about 0.1 μm or less, and the surface layer further comprises oxygen and has a concentration distribution of oxygen that decreases from the outer surface of the surface layer toward the photosensitive layer side of the surface layer.

2. The electrophotographic photoreceptor of claim 1, wherein the center line average roughness (Ra) of the surface of the surface layer is about 0.07 μm or less.

3. The electrophotographic photoreceptor of claim 1, wherein the center line average roughness (Ra) of the surface of the surface layer is about 0.05 μm or less.

4. The electrophotographic photoreceptor of claim 1, wherein the thickness of the surface layer is in a range of from about 0.03 μm to about 0.7 μm.

5. The electrophotographic photoreceptor of claim 1, wherein the thickness of the surface layer is in a range of from about 0.05 μm to about 0.5 μm.

6. The electrophotographic photoreceptor of claim 1, wherein a content of the nitrogen in the surface layer is about 60 atomic % or less.

7. The electrophotographic photoreceptor of claim 1, wherein a content ratio of the nitrogen and the group 13 element in the surface layer is in a range of from about 1.0:0.2 to about 1.0:2.0 as a ratio (x:y) between a total number x of group 13 element atoms and a total number y of nitrogen atoms.

8. A process cartridge comprising:

an electrophotographic photoreceptor including a photosensitive layer that includes a charge transport layer, and a surface layer laminated on a conductive substrate in this order, the surface layer being located on or above the charge transport layer; and at least one selected from the group consisting of an electrification device, a development device, a cleaning device, and an electricity removing device, wherein the process cartridge is detachable from an image forming device main body, the photosensitive layer includes an organic substance, the surface layer comprises nitrogen, at least one element selected from the group consisting of Ga and In, and hydrogen in a range of from 0.1 atomic % to 50 atomic %, thickness of the surface layer is from about 0.01 μm to less than about 1 μm, and a center line average roughness (Ra) of a surface of the surface layer is about 0.1 μm or less, and the surface layer further comprises oxygen and has a concentration distribution of oxygen that decreases from the outer surface of the surface layer toward the photosensitive layer side of the surface layer.

9. The process cartridge of claim 8, wherein the center line average roughness (Ra) of the surface of the surface layer is about 0.07 μm or less.

10. The process cartridge of claim 8, wherein the thickness of the surface layer is in a range of from about 0.03 μm to about 0.7 μm.

11. The process cartridge of claim 8, wherein a content of the nitrogen in the surface layer is about 60 atomic % or less.

12. The process cartridge of claim 8, wherein a content ratio of the nitrogen and the group 13 element in the surface layer is in a range of from about 1.0:0.2 to about 1.0:2.0 as a ratio (x:y) between a total number x of group 13 element atoms and a total number y of nitrogen atoms.

13. An image forming device comprising:

an electrophotographic photoreceptor including a photosensitive layer including a charge transport layer, and a surface layer laminated on a conductive substrate in this order, the surface layer being located on or above the charge transport layer;

an electrification device that electrifies a surface of the electrophotographic photoreceptor;

an exposure device that exposes the surface of the electrophotographic photoreceptor electrified by the electrification device to form an electrostatic latent image;

a development device that develops the electrostatic latent image by a developer containing a toner to form a toner image; and a transfer device that transfers the toner image onto a recording medium, wherein the photosensitive layer includes an organic substance, the surface layer comprises nitrogen, at least one element selected from the group consisting of Ga and In, and hydrogen in a range of from 0.1 atomic % to 50 atomic %, a thickness of the surface layer is from about 0.1 μm to less than about 1 μm, and a center line average roughness (Ra) of a surface of the surface layer is about 0.1 μm or less, and the surface layer further comprises oxygen and has a concentration distribution of oxygen that decreases from the outer surface of the surface layer toward the photosensitive layer side of the surface layer.

14. The image forming device of claim 13, wherein a content of the nitrogen in the surface layer is about 60 atomic % or less.

15. The image forming device of claim 13, wherein a content ratio of the nitrogen and the group 13 element in the surface layer is in a range of from about 1.0:0.2 to about 1.0:2.0 as a ratio (x:y) between a total number x of group 13 element atoms and a total number y of nitrogen atoms.

16. A method of manufacturing an electrophotographic photoreceptor, comprising:

activating a gas in which nitrogen gas and hydrogen gas are mixed; and then reacting the activated gas and an organometallic compound containing at least one element selected from the group consisting of Ga and In, while a cylindrical substrate having a photosensitive layer, including a charge transport layer, thereon is rotated around an axis to form a surface layer on the charge transport layer within the photosensitive layer whose surface temperature is less than about 100° C., wherein the surface layer further comprises oxygen and has a concentration distribution of oxygen that decreases from the outer surface of the surface layer toward the photosensitive layer side of the surface layer.

17. The method of manufacturing an electrophotographic photoreceptor of claim 16, wherein a concentration of hydrogen gas in the gas including nitrogen gas and hydrogen gas is in a range of from about 10% to about 95%.

18. The electrophotographic photoreceptor according to claim 1, wherein the surface layer comprises a dopant selected from the group consisting of Si, Ge, Sn, Be, Mg, Ca, Zn and Sr.

19. The process cartridge according to claim 8, wherein the surface layer comprises a dopant selected from the group consisting of Si, Ge, Sn, Be, Mg, Ca, Zn and Sr.

20. The image forming device according to claim 13, wherein the surface layer comprises a dopant selected from the group consisting of Si, Ge, Sn, Be, Mg, Ca, Zn and Sr.

21. The method of manufacturing an electrophotographic photoreceptor according to claim 16, wherein the surface layer comprises a dopant selected from the group consisting of Si, Ge, Sn, Be, Mg, Ca, Zn and Sr.

* * * * *